US007801461B2

(12) United States Patent
Hoshio et al.

(10) Patent No.: US 7,801,461 B2
(45) Date of Patent: Sep. 21, 2010

(54) CHARGING MEMBER CLEANING ROLLER, CHARGING MEMBER CLEANING ROLLER FOR CHARGING DEVICE, PROCESS CARTRIDGE AND IMAGE FORMING APPARATUS

(75) Inventors: Takuro Hoshio, Kanagawa (JP); Fumio Ojima, Kanagawa (JP); Yoshihiro Maekawa, Kanagawa (JP); Taichi Yamada, Kanagawa (JP); Nagahito Ichijo, Kanagawa (JP); Naoki Ohta, Kanagawa (JP); Hiroyuki Fukuda, Kanagawa (JP); Yoshinori Kubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 439 days.

(21) Appl. No.: 11/707,082

(22) Filed: Feb. 16, 2007

(65) Prior Publication Data

US 2008/0019729 A1 Jan. 24, 2008

(30) Foreign Application Priority Data

Jul. 18, 2006 (JP) ..... 2006-195954
Jul. 18, 2006 (JP) ..... 2006-195956

(51) Int. Cl.
*G03G 15/02* (2006.01)

(52) U.S. Cl. ..... 399/100

(58) Field of Classification Search ..... 399/100, 399/357; 15/256.51, 256.52
See application file for complete search history.

(56) References Cited

U.S. PATENT DOCUMENTS

| | | | | |
|---|---|---|---|---|
| 4,870,465 | A * | 9/1989 | Lindblad et al. | 399/347 |
| 5,751,801 | A * | 5/1998 | Murata et al. | 399/176 |
| 5,930,570 | A * | 7/1999 | Saito et al. | 399/279 |
| 6,459,867 | B2 | 10/2002 | Ohgoshi et al. | |
| 2001/0009618 | A1 * | 7/2001 | Ohgoshi et al. | 399/103 |
| 2005/0117944 | A1 * | 6/2005 | Kawada et al. | 399/349 |
| 2005/0191081 | A1 * | 9/2005 | Muraishi et al. | 399/100 |
| 2005/0255397 | A1 * | 11/2005 | Yamamoto et al. | 430/109.3 |
| 2006/0140692 | A1 * | 6/2006 | Abe et al. | 399/350 |

FOREIGN PATENT DOCUMENTS

| | | | |
|---|---|---|---|
| JP | A 02-272594 | | 11/1990 |
| JP | 05297690 | A * | 11/1993 |

(Continued)

OTHER PUBLICATIONS

Machine English Translation of JP10-063069.*

(Continued)

*Primary Examiner*—David M Gray
*Assistant Examiner*—Billy J Lactaoen
(74) *Attorney, Agent, or Firm*—Oliff & Berridge, PLC

(57) ABSTRACT

There is provided a charging member cleaning roller including: a core body; and an elastic layer that is provided on a peripheral surface of the core body and includes a polyurethane foam obtained from at least a polyester polyol, a foam stabilizer, and a catalyst. Moreover, there is provided a charging member cleaning roller including: a core body; and an elastic layer that is provided on a peripheral surface of the core body and includes a urethane foam having an open-cell structure, a resilience of approximately 15% to 30%, and a hardness of approximately 150N to 230N.

12 Claims, 11 Drawing Sheets

FOREIGN PATENT DOCUMENTS

| | | | |
|---|---|---|---|
| JP | A 05-297690 | | 11/1993 |
| JP | 10063069 | A * | 3/1998 |
| JP | B2 2847524 | | 11/1998 |
| JP | A-2004-258354 | | 9/2004 |
| JP | A 2004-361916 | | 12/2004 |
| JP | 2006154283 | A * | 6/2006 |

OTHER PUBLICATIONS

Machine English Translation of JP2006-154283.*

* cited by examiner

CHARGING MEMBER CLEANING ROLLER, CHARGING MEMBER CLEANING ROLLER FOR CHARGING DEVICE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2006-195956 filed Jul. 18, 2006 and No. 2006-195954 filed Jul. 18, 2006.

BACKGROUND

1. Technical Field

The present invention relates to a charging member cleaning roller which is applied to an image forming apparatus for forming an image by the electrophotographic method, and cleans a charging member for charging an image holding member. Moreover, the present invention relates to a charging device, a process cartridge, and an image forming apparatus using the charging member cleaning roller.

2. Related Art

A photoreceptor drum is used as the image holding member in image forming apparatuses such as electrophotographic copiers and laser beam printers, and in electrostatic recording apparatuses, which form a toner image on the surface of an image holding member and transfer the toner image onto paper by an electrophotographic method. Moreover, a corotron member is arranged with respect to the photoreceptor drum so that the surface of the photoreceptor drum is charged by the electric discharge from the corotron. However, when the corotron is used, in order to charge the surface of the photoreceptor drum to a predetermined potential, it is necessary to apply a high voltage of several kV, which causes a problem in that ozone is generated by the corona discharge, and the ozone causes deterioration of the photoreceptors or any rubber provided in the image forming apparatus. Therefore, in such an image forming apparatus using the corotron as described above, in addition to selecting the material and shape of members used in the apparatus, it is necessary to provide an exhaust fan for discharging the ozone to the outside of the apparatus, and to provide an auxiliary device which makes the ozone contained in the emission gas harmless.

Moreover, in an apparatus provided with such a corona discharge means, there is a problem in that, if dust in the air, fixing oil, or the like float inside the apparatus, the corotron wire gets dirty and the photoreceptor drum is not uniformly charged, so that image unevenness easily occurs. Here, in some cases, in order to periodically clean the corotron wire so as to prevent nonuniformity of the electric discharge, a device for periodically cleaning the wire is used by arranging a cleaning device or the like for the corotron wire. However, providing a cleaning device or the like for the corotron wire involves additionally providing an extra device, causing a problem in terms of space. Moreover, attaching an extra device to a small photoreceptor drum or the like causes a problem of increasing the constraints for designing the apparatus. In order to solve such an inconvenience in the case of using the corotron wire as described above, devices are drawing attention in which a charging member such as a charging roller is used to charge the photoreceptor drum by bringing into contact therewith.

Furthermore, mechanisms which use a charging member such as a charging roller generally utilize pulse discharge.

However, since the image holding member surface is charged by a pulse discharge generated in a minute space between the image holding member and the charging roller, the state of the image holding member surface becomes one of being continuously etched, resulting in further acceleration of film wearing of the image holding member, and having an adverse effect of becoming unsuable with long term usage in some cases.

Here, in order to suppress the pulse discharge so as to reduce the film wearing of the image holding member, a charging device is proposed in which charging involving applying a direct current voltage (DC) (hereunder, DC charging) is utilized as follows.

In this method, the image holding member surface is charged only by a direct current voltage and no alternating voltage is applied. Therefore the amount of current flowing into the image holding member is very small. That is, it means that the pulse discharge into the image holding member is also decreased, and it is considered that, as a result, the etching effect on the image holding member (photoreceptor) is reduced and the film wearing of the image holding member is kept small.

However, the following problems are present in DC charging.

The amount of discharging current in DC charging is determined by the resistance value of the contact charging roller, and the state of the pulse discharge greatly depends on the surface nature of the contact charging roller. Consequently, in order to uniformly charge the image holding member surface only by applying a direct current voltage, a more uniform electrical resistance and a surface smoothness are required compared to the case of superimposing an alternating voltage. Consequently, in order to improve the uniformity of the electrical resistance and the surface smoothness, a cost increment is unavoidable. Moreover, in DC charging, dirt (mainly external additives of the toner) is easily adhered onto the charging roller surface, and the adhered dirt changes the electrical resistance and the surface state, thereby easily interfering with uniform charging. The reason is considered that, since no alternating voltage is applied, no oscillating electric field is generated, and thus the dirt adhered onto the charging roller is hard to remove.

Therefore, in order to keep satisfactory images for a long time while reducing the film wearing of the image holding member by DC charging, a device for cleaning the charging roller or a device for preventing dirt from being adhered onto the charging roller is essential.

With respect to the above problem, there are attempted: a method of forming the surface layer of the charging roller from a highly releasable material; a method of applying a reverse bias that is opposite to the charging polarity at each of fixed timings, so as to reverse the polarity of a residue toner to move toward the image holding member; and so forth.

SUMMARY OF THE INVENTION

According to an aspect of the invention, there is provided a charging member cleaning roller including:

a core body; and an elastic layer that is provided on a peripheral surface of the core body and comprises a polyurethane foam obtained from at least a polyester polyol, a foam stabilizer, and a catalyst.

BRIEF DESCRIPTION OF THE DRAWINGS

Exemplary embodiments of the present invention will be described in detail based on the following figures, wherein.

DETAILED DESCRIPTION

Figure 1:
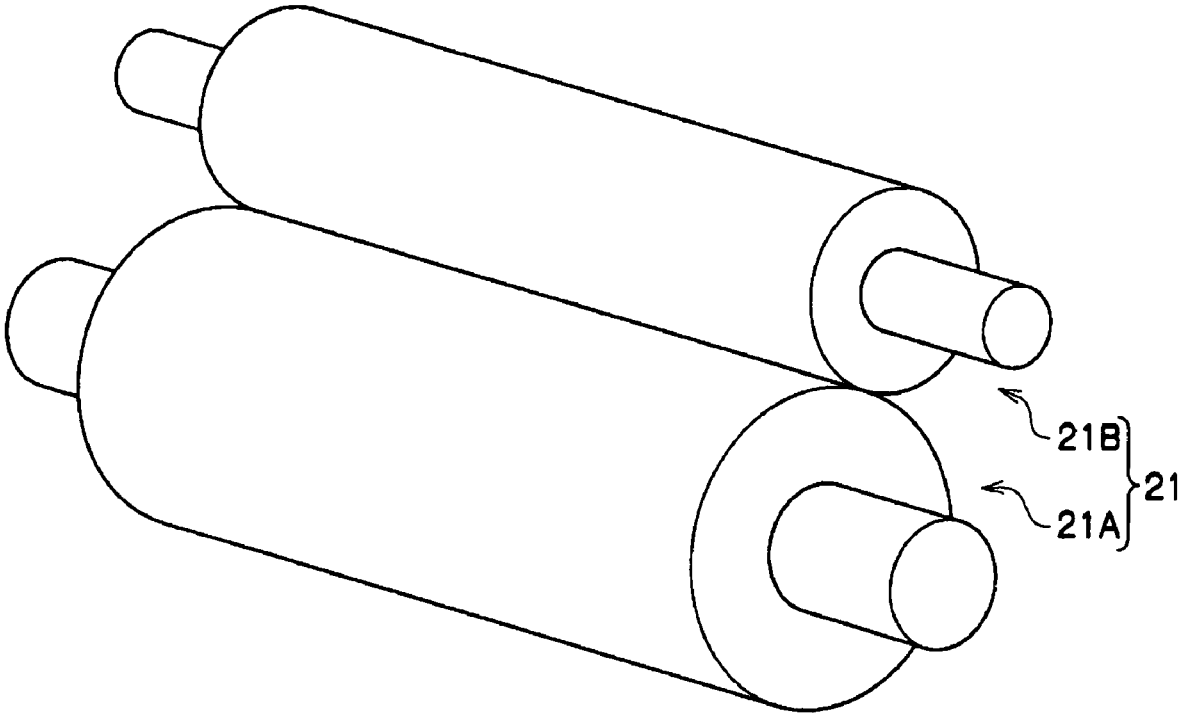
FIG. 1 is a schematic diagram showing an exemplary embodiment of a charging device of an aspect of the present invention.

Hereunder is a detailed description of exemplary embodiments of the present invention.

(Cleaning Roller)

A charging member cleaning roller according to an exemplary embodiment of an aspect of the present invention (hereunder, simply referred to as the cleaning roller of embodiment A of an aspect of the present invention) includes: a core body; and an elastic layer that is provided on the peripheral surface of the core body, and includes a polyurethane foam obtained from at least a polyester polyol, a foam stabilizer, and a catalyst. Moreover, as necessary, between the core body and the elastic layer may be provided an intermediate layer using a hot melt adhesive or the like; and on the peripheral surface of the elastic layer may be provided a surface layer using a fluoroplastic tube, an acrylic emulsion, or the like.

A charging member cleaning roller according to another exemplary embodiment of an aspect of the present invention (hereunder, simply referred to as the cleaning roller of embodiment B of an aspect of the present invention) includes: a core body; and an elastic layer that is provided on the peripheral surface of the core body, and includes a urethane foam having an open-cell structure, a resilience in a range of 15% to 30%, and a hardness in a range of 150N to 230N. Moreover, as necessary: between the core body and the elastic layer may be provided an intermediate layer using a publicly known adhesive, or a conductive adhesive having conductive particles such as a carbon black added in a thermoplastic resin such as an ethylene-vinyl acetate resin; and on the peripheral surface of the elastic layer may be provided a surface layer using a natural rubber latex, a butadiene rubber latex, a styrene-butadiene rubber latex, an acrylonitrile-butadiene rubber latex, an acrylic rubber latex, a polyurethane rubber latex, a polyester rubber latex, a polyester rubber latex, a fluoro rubber latex, or the like containing conductive particles such as a carbon black.

Next is a description of respective members of the cleaning roller of embodiment A of an aspect of the present invention and the cleaning roller of embodiment B of an aspect of the present invention (hereunder, both may be referred to as "cleaning roller of an aspect of the present invention").

The core material is described. As the core material, there is generally used a molding of iron, copper, brass, stainless steel, aluminum, nickel, and the like. In addition, as the core material, there may be also used a resin molding having conductive particles dispersed therein, or the like.

Here is a description of the elastic layer of the cleaning roller of embodiment A of an aspect of the present invention. As described above, the urethane foam of the elastic layer is obtained from at least a polyester polyol, a foam stabilizer, and a catalyst.

Here is a description of the polyester polyol. Examples of the polyester polyol include a condensed polyester polyol, specific examples of which include those obtained by a dibasic acid and a hydroxyl compound. That is, an adipate polyol obtained by dehydration condensation of these. Examples of the adipate polyol include an ethylene glycol adipate, a diethylene glycol adipate, a butylene glycol adipate, and a trimethylolpropane/diethylene glycol adipate.

Specific examples of the condensed polyester polyol include those obtained by condensation of a dicarboxylic acid (such as an adipic acid, a glutaric acid, a succinic acid, a sebacic acid, a pimelic acid, and a suberic acid), a diol (such as an ethylene glycol, a diethylene glycol, a 1,4-butanediol, a 1,6-hexanediol, a propylene glycol, and a neopentyl glycol) or a triol (such as a trimethylolethane and a trimethylolpropane).

Examples of the condensed polyester polyol also include a polycarbonate polyol (such as a polycarbonate diol having a structure in which an alkylene group (such as a hexylene group), a xylylene group, or the like is aligned in the main chain via a carbonate bond).

The polyester polyol may be solely used, or multiple types thereof may be used in combination.

The dosage of the polyester polyol may be such that the ratio of hydroxyl value in the polyester polyol to isocyanate groups in an isocyanate is desirably 0.5 to 1.5, more desirably 0.8 to 1.1, and yet more desirably 0.9 to 1.0.

Moreover, an isocyanate may be used so as to crosslink with the polyester polyol.

As the isocyanate, there may be used a tolylenediisocyanate, a diphenylmethanediisocyanate, a naphthalenediisocyanate, a tolidinediisocyanate, an isophoronediisocyanate, a hexamethylenediisocyanate, a xylylenediisocyanate, a hydrogenated xylenediisocyanate, a hydrogenated diphenylmethanediisocyanate, a triisocyanate, a tetramethylxylenediisocyanate, a lysine ester triisocyanate, a lysinediisocyanate, a trimethylhexamethylenediisocyanate, a dimer acid diisocyanate, and a norbornenediisocyanate. The isocyanate may be solely used, or two or more thereof may be used in combination.

Next is a description of the foam stabilizer. Examples of the foam stabilizer include an anionic surfactant and a cationic surfactant.

Specific examples of the anionic surfactant include: fatty acid soaps such as potassium laurate, sodium oleate, and sodium castor oil; sulfate esters such as octyl sulfate, lauryl sulfate, lauryl ether sulfate, and nonyl phenyl ether sulfate;

sulfonate salts such as sodium salt of alkylnaphthalenesulfonate, e.g., lauryl sulfonate, dodecyl sulfonate, dodecylbenzene sulfonate, triisopropylnaphthalene sulfonate, and dibutylnaphthalene sulfonate, naphthalene sulfonate formalin condensate, monooctyl sulfosuccinate, dioctyl sulfosuccinate, lauric acid amide sulfonate, and oleic acid amide sulfonate; phosphate esters such as lauryl phosphate, isopropyl phosphate, and nonyl phenyl ether phosphate; and sulfosuccinate salts such as sodium dialkyl sulfosuccinate, e.g., sodium dioctyl sulfosuccinate, disodium lauryl sulfosuccinate, and disodium lauryl polyoxyethylene sulfosuccinate.

Specific examples of the cationic surfactant include: amine salts such as laurylamine hydrochloride, strearylamine hydrochloride, oleylamine acetate, stearylamine acetate, and stearylaminopropylamine acetate; and quaternary ammonium salts such as lauryltrimethylammonium chloride, dilauryldimethylammonium chloride, distearylammonium chloride, distearyldimetylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenedimethylammonium chloride, and alkyltrimethylammonium chloride.

Among them, sulfate esters such as octyl sulfate, lauryl sulfate, lauryl ether sulfate, and nonyl phenyl ether sulfate are desirable in terms of the form stability. The foam stabilizer may be solely used, or two or more thereof may be used in combination.

Here, because abnormal images are generated by contamination of the charging member, a foam stabilizer other than generally used silicone surfactants such as dimethyl silicone oil and polyether denatured silicone oil, may be used as the foam stabilizer.

The dosage of the foam stabilizer is desirably 0.1 to 5 weight %, more desirably 0.3 to 3 weight %, and yet more desirably 0.5 to 2 weight %, based on the total amount of the polyol and the isocyanate.

Next is a description of the catalyst. Example of the catalyst include: amine compounds such as triethylamine, tetramethylethylenediamine, triethylenediamine (TEDA), bis(N,N-dimethylamino-2-ethyl)ether, N,N,N',N'-tetramethylhexamethylenediamine, bis(2-dimethylaminoethyl)ether (trade name: TOYOCAT-ET, manufactured by Tosoh Corporation); metal carboxylate such as potassium acetate and potassium octylate; and organic metal compounds such as dibutyltin dilaulate. Among them, an amine catalyst may be used in terms of the suitability for manufacturing a water foaming polyurethane foam. These reactive catalysts may be solely used, or two or more thereof may be used in a mixture.

The dosage of the catalyst is desirably 0.01 to 5 weight %, more desirably 0.05 to 3 weight %, and yet more desirably 0.1 to 1 weight %, based on the total amount of the polyol and the isocyanate. If a catalyst is not used, unreacted polymers remain on the cleaning roller and bleed in the contact area with the charging member, causing image defects.

Next is a description of other components which may be added. Examples of other compounds which may be added include a conductive agent. Examples of the conductive agent include carbon conductive agents such as Ketchen black, acetylene black, oil furnace black, and thermal black, and ionic conductive agents such as ammonium compounds, e.g., tetraethylammonium and stearyltrimethylammonium chloride.

Examples of other components which may be added also include additives such as a flame retardant, an antidegradant, and a plasticizer. These other components may be solely used, or two or more thereof may be used in combination. These additives may be solely used, or two or more thereof may be simultaneously used.

Next is a description of a method of manufacturing the urethane foam. The method of manufacturing the urethane foam is not specifically limited, and may be according to an ordinary method, an example of which is as follows. Firstly, as raw materials, a polyurethane polyol, a foam stabilizer, a catalyst, and as necessary a conductive agent, and the like are mixed, and are then heated to effect a reaction of curing, so as to obtain the urethane foam.

The temperature and time for mixing the raw materials are not specifically limited. The temperature for mixing is normally in a range of 10 to 90° C., and desirably 20 to 60° C. The time for mixing is normally about 10 seconds to 20 minutes, and desirably 30 seconds to 5 minutes. Moreover, when the mixture is heated to effect a reaction of curing, the polyurethane foam can be obtained by foaming using a conventionally and publicly known method.

Here, the foaming method is not specifically limited, and any method may be used such as a method of using a foaming agent, and a method of mixing in bubbles by means of mechanical agitation.

The elastic layer of the cleaning roller of embodiment B of an aspect of the present invention is described. As mentioned above, the urethane foam forming the elastic layer has an open-cell structure, a resilience of 15% to 30%, and a hardness of 150N to 230N. Here, the "open-cell structure" means a structure having multiple cells inside of the urethane foam in a state where adjacent cells are joined with each other.

The resilience of the urethane foam is 15% to 30%, preferably 18% to 27%, and more preferably 20% to 25%. By bringing this resilience into the above range, a sufficient cleaning performance of the cleaning roller may be obtained.

If this resilience is less than 15%, the force generated for restoring from the compressed state where the cleaning roller is in contact with the charging member, is too weak to obtain a sufficient cleaning performance, and thus transfer residue of toner and foreign matter are adhered/accumulated on the charging member, generating defects in the image.

On the other hand, if this resilience is greater than 30%, even if the cleaning performance is satisfactory, the force generated for restoring from the compressed state where the cleaning roller is in contact with the charging member, is too strong, nonuniformly increasing the shaved amount of the charging member surface. Therefore, if the charging member is continuously used, the charging ability is nonuniformly decreased, generating stripe shaped defects in the image.

Here, the resilience of the foam urethane can be controlled by, for example a crosslink point concentration for synthesizing polyurethane and a number of bubbles (cells) in the foam body. As the crosslink point concentration gets higher, the resilience is prone to be increased. Moreover, as the number of bubbles (cells) in the foam body is greater, the resilience is prone to be decreased.

The measurement of the resilience is according to JIS-K-6400 (1997), the disclosure of which is incorporated by reference herein. A test piece of 50×100×100 mm or more is cut out. A steel ball having a diameter of 16 mm and a weight of 16 g is dropped down from a height of 500 mm to the top face of the test piece. The maximum height of rebound is represented by a percent (%) of the drop height (500 mm).

The hardness of the polyurethane foam is 150N to 230N, more preferably 170N to 220N, and yet more preferably 190N to 210N. When this hardness is in the above range, a sufficient cleaning performance of the cleaning roller may be obtained.

If this hardness is less than 150N, even if the abovementioned force generated for restoring the cleaning roller is sufficient, the effect of getting rid of adhered substances on the charging member may be decreased, and satisfactory cleaning performance may not be demonstrated.

On the other hand, if this hardness is greater than 230N, even if the cleaning performance is satisfactory, the surface of the charging member is scratched at an early stage, generating fine stripe shaped defects in the image.

Here, the hardness of the urethane foam may be controlled by the crosslink point concentration for synthesizing polyurethane. As the crosslink point concentration gets higher, the hardness is prone to be increased.

The measurement of the hardness is according to JIS-K-6400 (1997), the disclosure of which is incorporated by reference herein. A test piece of 50×380×380 mm is cut out, which is vertically pushed in such that the thickness thereof becomes 75% of the initial thickness. Immediately after that, the load is removed, and again the test piece is pushed in such that the thickness thereof becomes 25% of the initial thickness, which is then left still for 20 seconds. The load at this time is read out.

The urethane foam preferably has a number of bubbles (number of foamed cells) in the open-cell structure in a range of 40 cells/25 mm to 58 cells/25 mm, more preferably a range of 45 cells/25 mm to 55 cells/25 mm, and yet more preferably a range of 48 cells/25 mm to 53 cells/25 mm. When this number of cells is in the above range, the cleaning roller may demonstrate a further improved cleaning performance.

If this number of cells is less than 40 cells/25 mm, the cleaning roller itself may increase the effect of scratching the charging member surface with the adhered substance on the charging member, and the contamination of the charging member may be worsened.

On the other hand, if the number of cells is more than 58 cells/25 mm, the strength of the skeleton part of the foam body held by the mesh constituted by fine cells may be decreased, and the cleaning roller itself may be easily torn off or peeled off. Furthermore, the resilience may be decreased, causing a problem of damaging the cleaning performance. The number of cells may be controlled by the dosage of a publicly known foaming agent such as carbon dioxide and a fluorine compound.

Here, the number of cells is measured using an optical microscope by means of a visual observation, in which a line having a length of 50 mm is drawn in an arbitrary position on the surface of a test piece of 100×100×10 mm, and the number of cells on the line is counted so as to obtain the number of cells per 25 mm. The line is drawn in three arbitrary positions on the test piece, and the average value of these three positions is set as the number of cells.

The urethane foam may be either one of a polyester polyurethane foam and a polyether urethane foam, but is desirably a polyester urethane foam. Since the polyester urethane foam has a hydrophilic property, if it is used as the cleaning roller, adhered substances on the charging member surface are readily adsorbed and a further improved cleaning performance may be demonstrated.

The polyester foam is obtained from, for example at least a polyester polyol and an isocyanate. Moreover, as required, other additives such as a foam stabilizer, a catalyst, a curing agent, a crosslinking agent, a foaming agent, a flame retardant, an antidegradant, a plasticizer, and a conductive agent may be used.

Here is a description of the polyester polyol. Suitable examples of the polyester polyol include a condensed polyester polyol, specific example of which include those obtained by a dibasic acid and a hydroxyl compound, that is, an adipate polyol obtained by dehydration condensation of these. Specific examples of the adipate polyol include those described for the elastic layer in the cleaning roller of embodiment A of an aspect of the present invention. Specific examples of the condensed polyester polyol include those described for the elastic layer in the cleaning roller of embodiment A of an aspect of the present invention.

The polyester polyol may be solely used, or two or more thereof may be used in combination.

The amount of the polyester polyol to be used is preferably 68 weight % to 80 weight %, and more preferably 70 weight % to 78 weight %, based on the total solid amount constituting the elastic layer.

Next is a description of the isocyanate. As the isocyanate, there may be used a tolylenediisocyanate, a diphenylmethanediisocyanate, a naphthalenediisocyanate, a tolidinediisocyanate, an isophoronediisocyanate, a hexamethylenediisocyanate, a xylylenediisocyanate, a hydrogenated xylene diisocyanate, a hydrogenated diphenylmethanediisocyanate, a triisocyanate, a tetramethylxylenediisocyanate, a lysine ester triisocyanate, a lysinediisocyanate, a trimethylhexamethylenediisocyanate, a dimer acid diisocyanate, and a norbornenediisocyanate. The isocyanate may be solely used, or two or more thereof may be used in combination.

The dosage of the isocyanate may be 16 weight % to 28 weight %, and desirably 18 weight % to 26 weight %, based on the total solid amount constituting the elastic layer.

Next is a description of other additives. For example, suitable examples of the foam stabilizer include an anionic surfactant and a cationic surfactant.

Specific examples of the anionic surfactant include those described for the elastic layer in the cleaning roller of embodiment A of an aspect of the present invention. Specific examples of the cationic surfactant include those described for the elastic layer in the cleaning roller of embodiment A of an aspect of the present invention.

The foam stabilizer may be solely used, or two or more thereof may be used in combination.

The amount of the foam stabilizer to be used is preferably 1.4 weight % to 1.6 weight %, and more preferably 1.4 weight % to 1.5 weight %, based on the total solid amount constituting the elastic layer.

Examples of the catalyst include an amine compound and an organic metal compound. Examples of the amine compound include triethylamine, tetramethylethylenediamine, and triethylenediamine. Examples of the organic metal compound include dibutyltin dilaurate, dioctyltin dilaurate, and dibutyltin dimalate.

The catalyst may be solely used, or two or more thereof may be used in combination.

The dosage of the catalyst is preferably 0.47 weight % to 0.97 weight %, and more preferably 0.5 weight % to 0.95 weight %, based on the total solid amount constituting the elastic layer. If a catalyst is not used, unreacted polymers remain on the cleaning roller and bleed in the contact area with the charging member, causing image defects.

Examples of the conductive agent include carbon conductive materials such as Ketchen black, acetylene black, oil furnace black, and thermal black, and ionic conductive materials such as ammonium compounds, e.g., tetraethylammonium and stearyltrimethylammonium chloride.

Next is a description of a method of manufacturing the urethane foam. The method of manufacturing the urethane foam is not specifically limited, and may be according to an ordinary method, an example of which is as follows. Firstly, as raw materials, a polyol, an isocyanate, and as necessary other additives are mixed, and are then heated to effect a reaction of curing, so as to obtain the urethane foam.

The temperature and time for mixing the raw materials are not specifically limited. The temperature for mixing is normally in a range of 10 to 90° C., and desirably 20 to 60° C. The time for mixing is normally about 10 seconds to 20 minutes, and desirably 30 seconds to 5 minutes. Moreover, when the mixture is heated to effect a reaction of curing, the polyurethane foam can be obtained by foaming using a conventionally and publicly known method.

Here, the foaming method is not specifically limited, and any method may be used such as a method of using a foaming agent, and a method of mixing in bubbles by means of mechanical agitation.

Next is a description of suitable exemplary embodiments of the cleaning roller of an aspect of the present invention. The cleaning roller may be either insulative or conductive. That is, the conductive layer may be either insulative or conductive.

If the cleaning roller of an aspect of the present invention is conductive, it may have also have a function as a charging member which charges the image holding member. Moreover, a cleaning bias may be applied thereto. Furthermore, said "conductive" includes semiconductive.

Here, "insulative" means a range of $10^{12}$ Ω·cm or more in the volume resistivity. On the other hand, "conductive" means a range of $10^{10}$ Ω·cm or less in the volume resistivity.

The measurement of the volume resistivity is according to JIS-K-6911 (1995), the disclosure of which is incorporated by reference herein. A circular electrode (UR probe of HIRESTER IP manufactured by Mitsubishi Yuka Kabushiki Kaisha: cylindrical electrode outer diameter ϕ16 mm, ring electrode inner diameter ϕ30 mm, and outer diameter ϕ40 mm) is used, and under a condition of 22° C./55% RH, a voltage of 100 V is applied. The current value at 5 seconds after the application is measured by using a micro current meter R8340A manufactured by ADVANTEST CORPORATION. The volume resistivity is obtained from the current value and the volume resistance.

The method of making the cleaning roller of an aspect of the present invention conductive is not specifically limited, and may be a method of kneading a conductive material in the elastic layer, and a method of spraying a conductive powder thereto. However, an impregnation method is desirably applied in which the cleaning roller is impregnated with a conductive coating liquid whose electrical resistance is adjusted to 103 to $10^{10}$ Ω·cm (desirably $10^4$ to $10^8$ Ω·cm). According to the impregnation method, it is possible to produce the cleaning roller having a very stable volume resistivity, with a very low cost. Examples of such a conductive coating liquid includes urethane, silicone, styrene, or the like having carbon dispersed therein which is dissolved in a solvent (such as ethyl acetate, toluene, and methylethylketone).

Next is a description of a method of manufacturing the cleaning roller of an aspect of the present invention. Examples of the method of manufacturing the cleaning roller include: a method in which a raw material is injected into a mold and foamed, then the urethane foam in a desired shape is coated on the core material; and a method in which a urethane foam slab is obtained and processed in a desired shape by grinding or the like, and then coated on the core material.

(Charging Device)

As shown in FIG. 1, the charging device of an aspect of the present invention has for example, a charging roller 21A for charging a charge target member (such as an image holding member) and a cleaning roller 21B arranged in contact with the peripheral surface of the charging roller 21A. The cleaning roller of an aspect of the present invention is applied as the cleaning roller 21B. In the drawing, 21 denotes the charging device.

The cleaning roller 21B is set such that the peripheral surface (elastic layer surface) thereof is, for example, detachably in contact with the peripheral surface of the charging roller 21A, and the cleaning roller 21B is reciprocally movable in the axial direction of the charging roller 21A. As a result, in a case where cleaning is not necessary (such as a case where the image forming apparatus is halted for a long time), the cleaning roller 21B can be put separately from the charging roller 21A, and the surface of the charging roller 21A may be uniformly cleaned.

When the cleaning roller 21B is in contact with the charging roller 21A, it is put in a state of being pressed by the charging roller 21A, so as to be driven to rotate together with the rotation of the charging roller 21A. As a result, scratches on the charging roller 21A may be prevented.

In the charging device of an aspect of the present invention, while the charging roller surface is being cleaned by the cleaning roller 21B, the charge target member (such as an image holding member) can be charged by the charging roller 21A.

Moreover, in the case of the cleaning roller of embodiment A of an aspect of the present invention, an application of a cleaning roller described later enables satisfactory cleaning of the charging roller 21A for a long time.

Furthermore, in the case of the cleaning roller of embodiment B of an aspect of the present invention, substances adhered on the charging member surface may be efficiently removed, a satisfactory cleaning performance may be kept for a long time, and it becomes possible to prevent image defect generation caused by contamination due to transfer residue of toner and foreign matter adhered/accumulated on the charging member surface.

Hereunder is a description of the charging roller. The reference symbols are omitted in the description.

The charging roller is a member of a contact charging type, and is capable of suppressing a decrease in the film thickness of the image holding member. Moreover, the charging roller of a contact charging type is to charge the image holding member surface by applying a voltage to a conductive member that has been brought into contact with the image holding member surface.

Examples of the charging roller include those including of a core body having an elastic layer and a resistive layer sequentially formed on the peripheral surface thereof. The outside of the resistive layer may be provided with a protective layer as necessary.

The charging roller may be arranged pressingly in contact with the image holding member, so as to be driven to rotate together with the rotation of the image holding member. Moreover, the charging roller may be fitted with a driving device, and arranged so as to rotate at a different peripheral velocity from that of the image holding member.

Next is a description of respective members of the charging roller. The core body is conductive, and there is generally used a molding of iron, copper, brass, stainless steel, aluminum, nickel, or the like. In addition, there may be also used a resin molding having conductive particles dispersed therein, or the like.

Next is a description of the elastic layer. The elastic layer is for example conductive or semiconductive, and is generally a rubber material having conductive particles or semiconductive particles dispersed therein.

As to the rubber material, there may be used EPDM, polybutadiene, natural rubber, polyisobutylene, SBR, CR, NBR, silicone rubber, urethane rubber, epichlorohydrin rubber, SBS, thermoplastic elastomer, norbornene rubber, fluorosilicone rubber, ethyleneoxide rubber, and the like.

As to the conductive particles or the semiconductive particles, there may be used carbon black, metals such as zinc, aluminum, copper, iron, nickel, chromium, and titanium, and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO. These materials may be solely used, or two or more thereof may be used in a mixture.

The resistive layer and the protective layer each may be a layer including a binder resin having conductive particles or semiconductive particles dispersed therein so as to control the resistance, with a volume resistivity of $10^3$ to $10^{14}$ Ω·cm, desirably $10^5$ to $10^{12}$ Ω·cm, and more desirably $10^7$ to $10^{12}$ Ω·cm. The film thicknesses of the resistive layer and the protective layer are each preferably 0.01 to 1000 μm, desirably 0.1 to 500 μm, and more desirably 0.5 to 100 μm.

As to the binder resin, there may be used an acrylic resin, a cellulose resin, a polyamide resin, a methoxymethylated nylon, an ethoxymethylated nylon, a polyurethane resin, a polycarbonate resin, a polyester resin, a polyethylene resin, a polyvinyl resin, a polyalylate resin, a polythiophene resin, a polyolefine resin, PFA (Tetrafluoroethylene perfluoroalkoxy vinyl ether copolymer), FEP (Perfluoroethylene-propylene copolymer), and PET (Polyethylene terephthalate), a styrenebutadiene resin, or the like.

As to the conductive particles or the semiconductive particles, there may be used carbon black, metals, and metal oxides, similar to those of the elastic layer. Moreover, as required, an antioxidant such as hindered phenol and hindered amine, a filler such as clay and kaoline, and a lubricant such as silicone oil may be added thereto.

As to the method of forming these layers, there may be used blade coating, wire-bar coating, spray coating, dip coating, bead coating, air knife coating, curtain coating, or the like.

Examples of the method of charging the image holding member by using the charging roller include a method of applying a voltage to the charging roller wherein the applied voltage may be a direct current voltage or a direct current voltage superimposed with an alternating voltage. These methods are not specifically limited, however a method of applying a direct current voltage is desirable. In particular, if the image holding member surface is charged only by a direct current voltage, no alternating voltage is applied. Therefore the amount of current flowing into the image holding member is very small. That is, it means that the pulse discharge into the image holding member is also decreased, and it is considered that, as a result, the etching effect on the image holding member (photoreceptor) may be reduced and the film wearing of the image holding member may be kept small.

On the other hand, the charging roller surface is more easily contaminated in the case where only a direct current voltage is applied to the charging roller, rather than the case where a direct current voltage superimposed with an alternating voltage is applied thereto. The reason is explained as follows. If a direct current voltage superimposed with an alternating voltage is applied, positive and negative electric fields alternatively and continually occur on the charging roller surface due to the application of the alternating voltage, and thus positively charged contaminants and negatively charged contaminants receive an electrostatically repulsive force against the charging roller surface, which enables to relatively readily remove the adhered substances from the charging roller surface. It is possible to use a conventionally known cleaning roller including a resin in a brush shape, a pad shape, or a roller shape.

However, if only a direct current voltage is applied to the charging roller, a positive or negative single polar voltage is always applied to the charging roller surface, contributing a state where a toner, toner additives, and foreign matter such as paper powder having the opposite polarity to the charging polarity are easily adhered and difficult to remove. If the above conventionally known cleaning roller including a resin in a brush shape, a pad shape, or a roller shape is used, a satisfactory cleaning performance may not be obtained. However, by using the cleaning roller of embodiment B of an aspect of the present invention, a satisfactory cleaning performance may be obtained.

Here, the range of the voltage is preferably positive or negative 50 to 2000 V according to the required electrostatic charge potential of the image holding member, and particularly desirably 100 to 1500 V. If an alternating voltage is superimposed, the peak-to-peak voltage is 400 to 1800 V, desirably 800 to 1600 V, and more desirably 1200 to 1600 V. The frequency of the alternating voltage may be 50 to 20,000 Hz, and desirably 100 to 5,000 Hz.

(Image Forming Apparatus and Process Cartridge)

Figure 2:
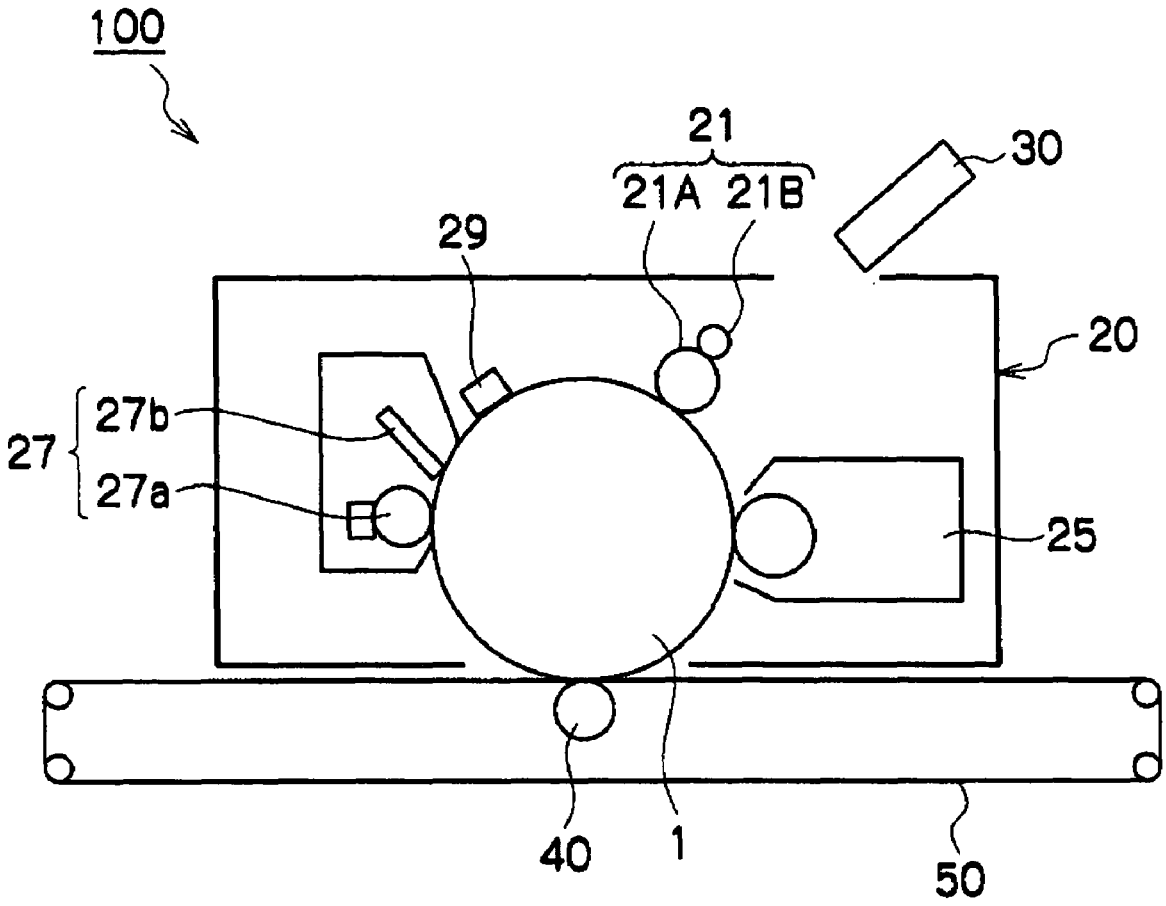
FIG. 2 is a schematic diagram showing an exemplary embodiment of an image forming apparatus of an aspect of the present invention.

FIG. 2 is a schematic diagram showing an exemplary embodiment of the image forming apparatus of an aspect the present invention. The image forming apparatus 100 shown in FIG. 2 includes at least a process cartridge 20 having a charging device 21, an exposure device 30, a transfer device 40, and an intermediate transfer body 50 in an image forming apparatus mainbody (not shown). In the image forming apparatus 100, the exposure device 30 is arranged in a position allowing the electrophotographic photoreceptor 1 (image holding member) to be exposed from the opening of the process cartridge 20, the transfer device 40 is arranged in the opposed position to the electrophotographic photoreceptor 1 through the intermediate transfer body 50, and the intermediate transfer body 50 is arranged so as to be partially in contact with the electrophotographic photoreceptor 1.

The process cartridge 20 includes a casing in which the charging device 21, the electrophotographic photoreceptor 1, a developing device 25, a cleaning device 27, and a fibrous member (flat brush shape) 29 are combined and integrated by an installation rail. The cleaning device 27 includes a fibrous member (roll shape) 27*a* and a cleaning blade (blade member) 27*b*. In the casing is provided an opening for light exposure.

Moreover, the charging device of an aspect of the present invention is applied as the charging device 21. As described above, the charging device 21 includes the charging roller 21A and the cleaning roller 21B.

Figure 11:
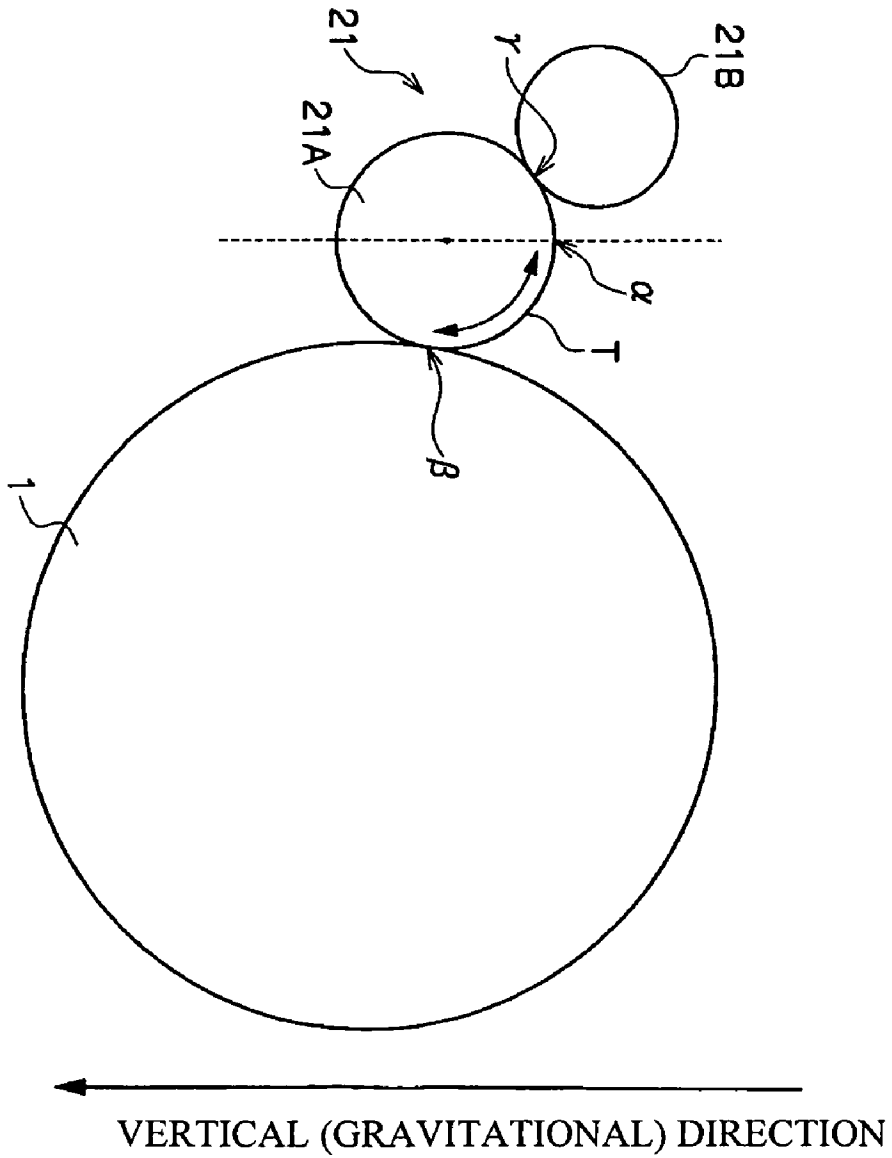
FIG. 11 is a schematic diagram for explaining the position of arrangement of the charging member cleaning roller and the charging roller.

Here, in the cleaning roller of embodiment A of an aspect of the present invention, the cleaning roller 21B may be arranged in contact with the charging roller 21A in the following condition. As shown in FIG. 11, in the cross-section orthogonal to the respective axes of the charging roller 21A, the cleaning roller 21B, and the electrophotographic photoreceptor 1, the cleaning roller 21B may be arranged so that a contact area γ of the cleaning roller 21B and the charging roller 21A is not positioned on the circumference T of the charging roller 21A between the position α and the position β on the side of the arrangement position of the electrophotographic photoreceptor 1 from the axis point of the charging roller 21A, assuming that α is the position on the vertically upper side from the axis point of the charging roller 21A among the crossing positions of the line vertically passing through the axis point of the charging roller 21A and the circumference of the charging roller 21A, and β is a contact position of the charging roller 21A and the electrophotographic photoreceptor 1.

By arranging the cleaning roller 21B in this way, it is possible to prevent foreign matter falling down from the cleaning roller from dropping on the charging roller 21A and the electrophotographic photoreceptor 1. Therefore, since defective charge to the electrophotographic photoreceptor 1 due to such a foreign matter may be suppressed, color spot generation on the image may be prevented, and thus image defects may be prevented for a long time.

Figure 6:
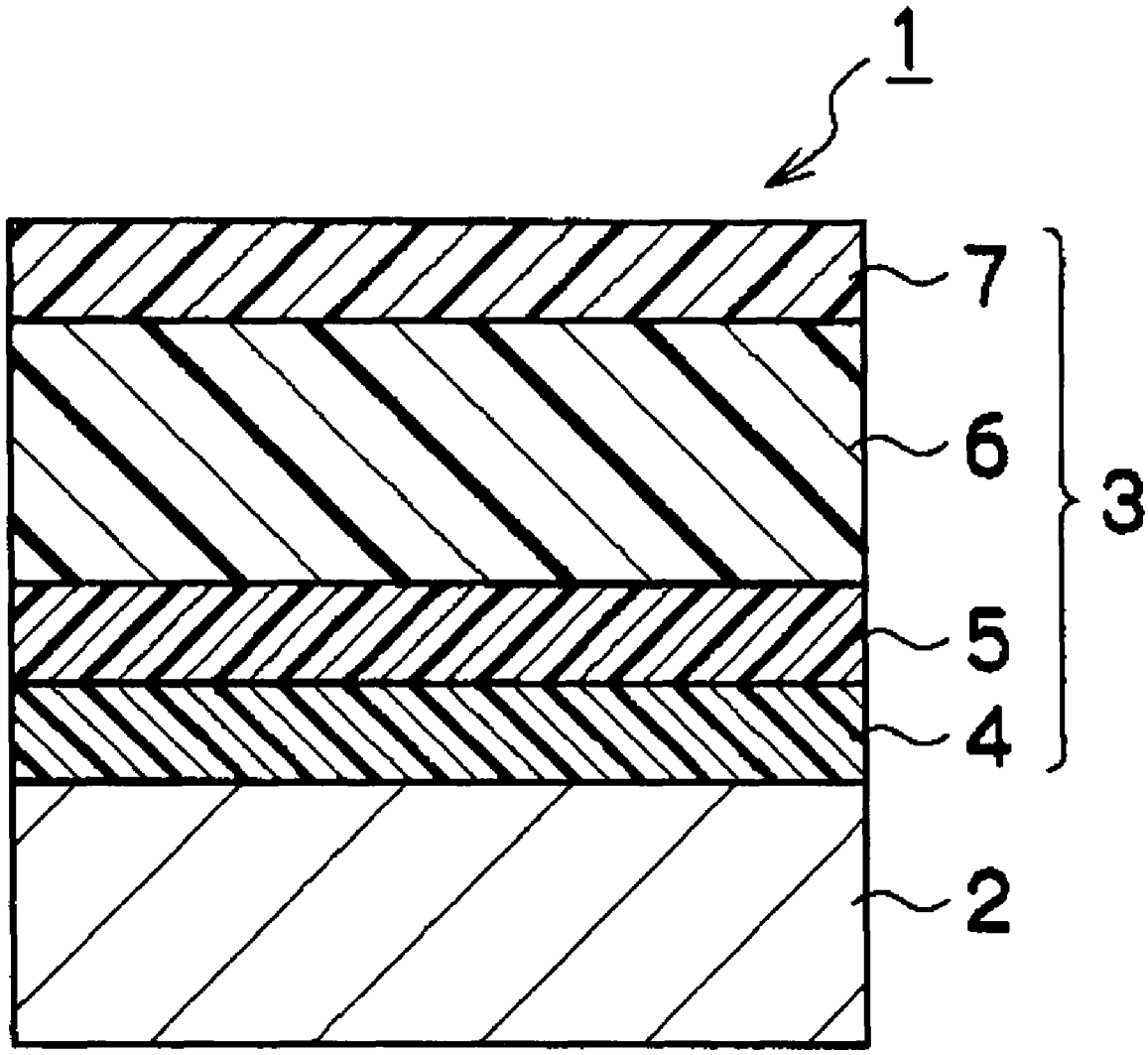
FIG. 6 is a cross-sectional schematic diagram showing an exemplary embodiment of an electrophotographic photoreceptor.

Next is a description of the electrophotographic photoreceptor 1. FIG. 6 is a cross-sectional schematic diagram showing an exemplary embodiment of the electrophotographic photoreceptor of an aspect of the present invention. The electrophotographic photoreceptor 1 shown in FIG. 6 includes a conductive support 2 and a photosensitive layer 3. The photosensitive layer 3 has a structure in which an undercoating layer 4, a charge generating layer 5, a charge transporting layer 6, and a protective layer 7 are sequentially laminated, on the conductive support 2.

Figure 9:
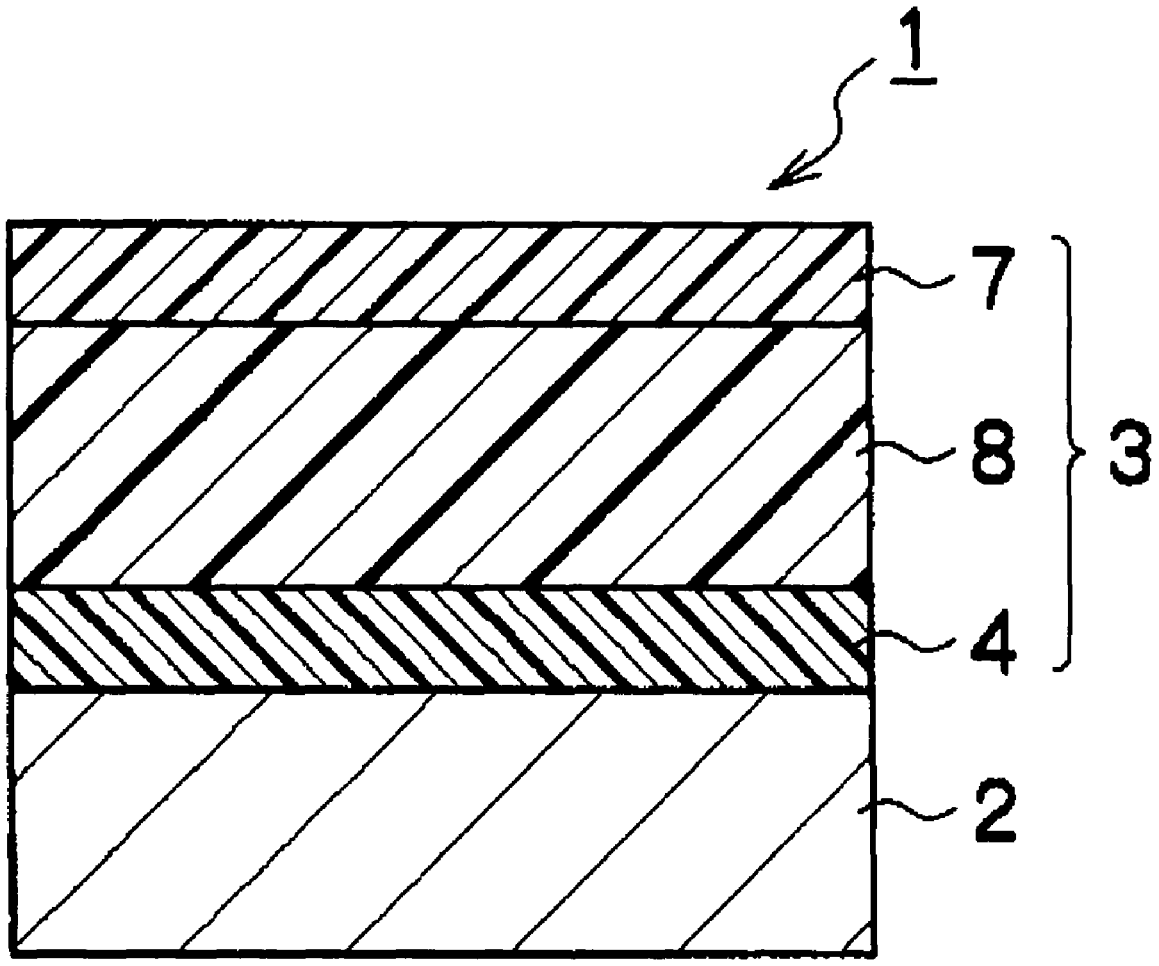
FIG. 9 is a cross-sectional schematic diagram showing yet another exemplary embodiment of the electrophotographic photoreceptor.
Figure 10:
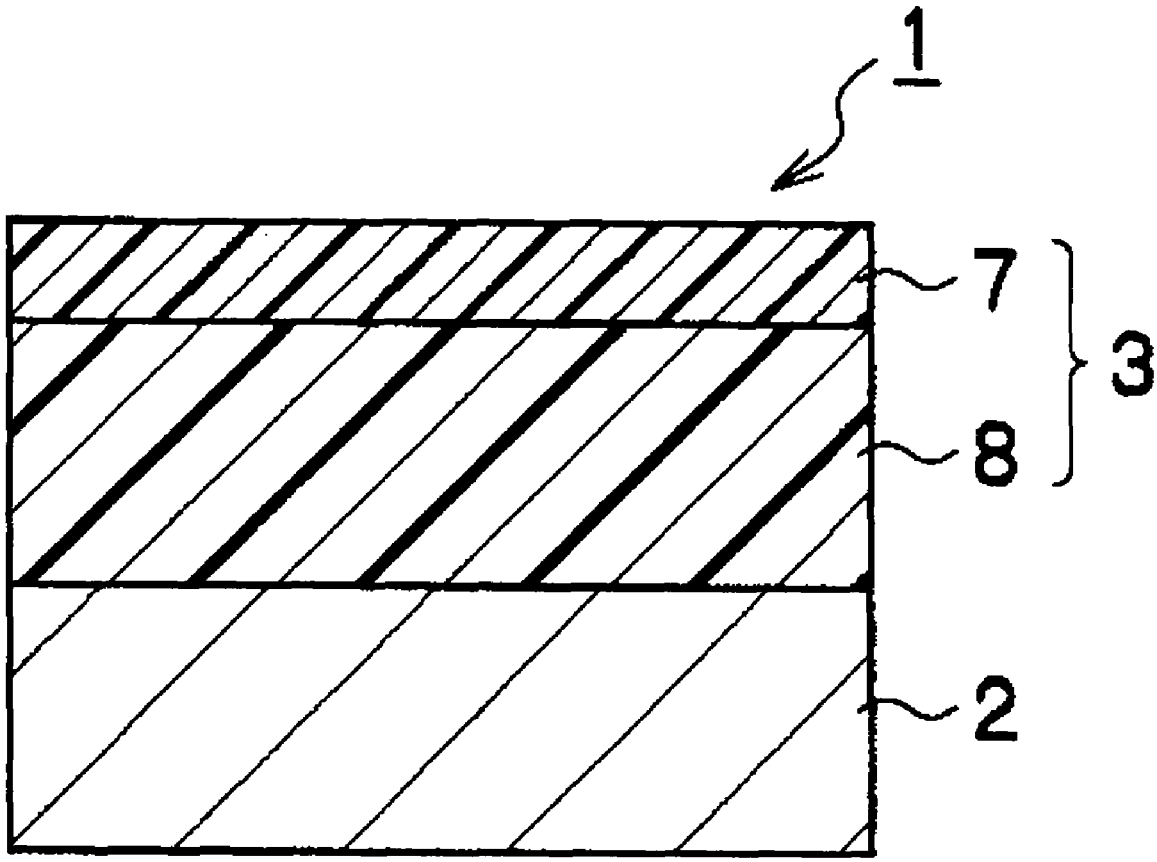
FIG. 10 is a cross-sectional schematic diagram showing yet another exemplary embodiment of the electrophotographic photoreceptor.

Moreover, FIG. 7 to FIG. 10 are respectively cross-sectional schematic diagrams showing other exemplary embodiments of the electrophotographic photoreceptor of an aspect of the present invention. Similarly to the electrophotographic photoreceptor shown in FIG. 6, the electrophotographic photoreceptors shown in FIG. 7 and FIG. 8 include the photosensitive layer 3 having separate functions of the charge generating layer 5 and the charge transporting layer 6. In FIG. 9 and FIG. 10, a charge generating material and a charge transporting material are contained in one layer (single layer type photosensitive layer 8).

Figure 7:
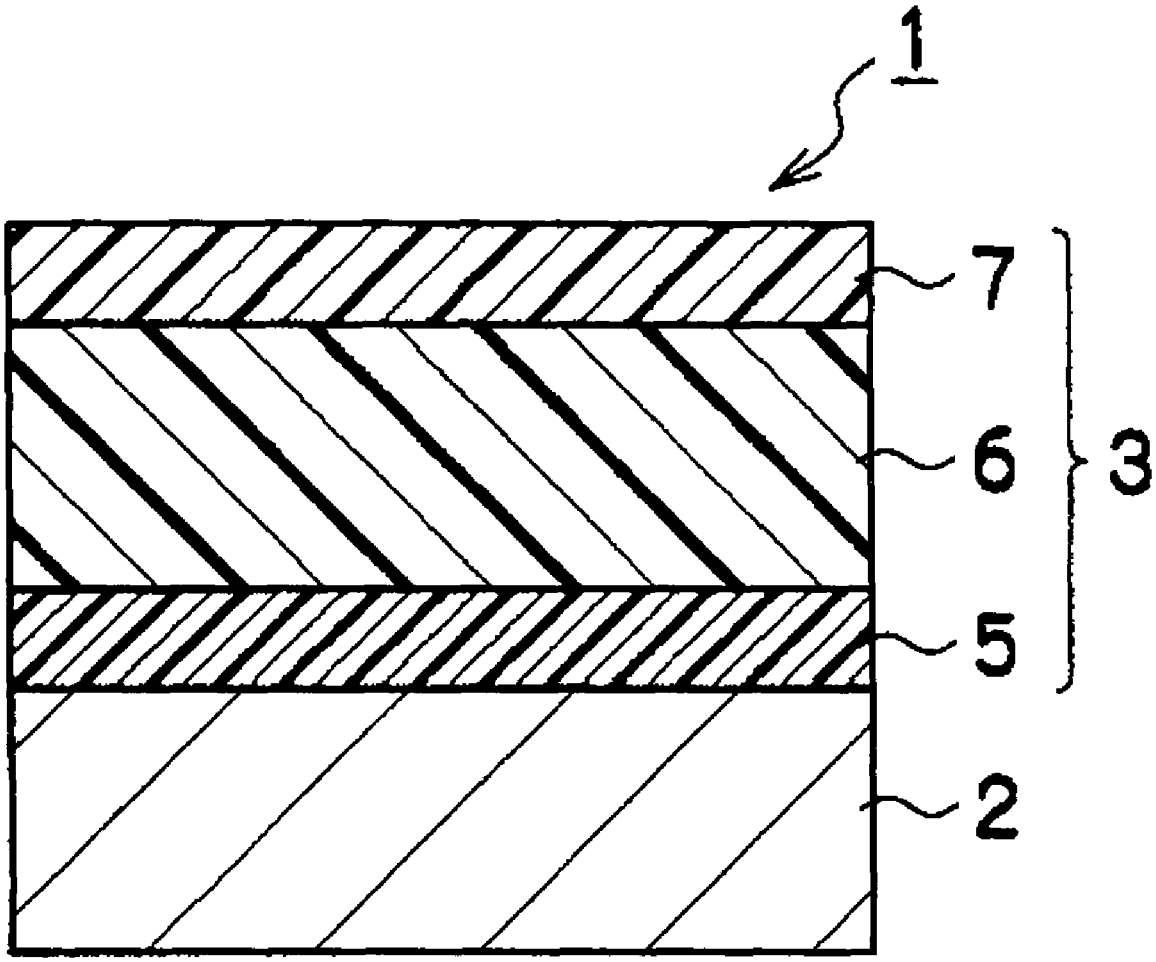
FIG. 7 is a cross-sectional schematic diagram showing another exemplary embodiment of the electrophotographic photoreceptor.
Figure 8:
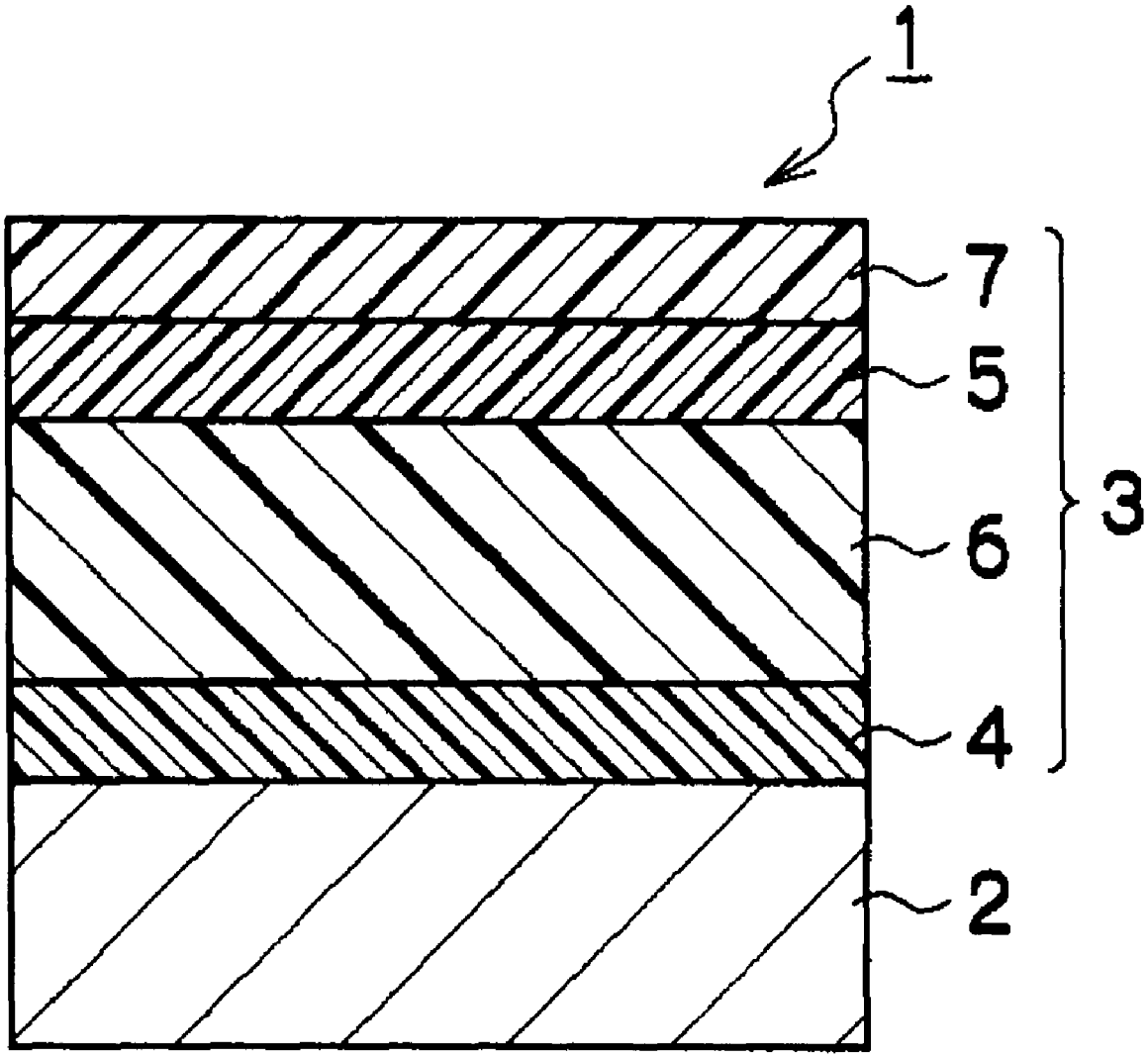
FIG. 8 is a cross-sectional schematic diagram showing yet another exemplary embodiment of the electrophotographic photoreceptor.

The electrophotographic photoreceptor 1 shown in FIG. 7 has a structure in which the conductive support 2 has the charge generating layer 5, the charge transporting layer 6, and the protective layer 7 sequentially laminated thereon. Moreover, the electrophotographic photoreceptor 1 shown in FIG. 8 has a structure in which the conductive support 2 has the undercoating layer 4, the charge transporting layer 6, the charge generating layer 5, and the protective layer 7 sequentially laminated thereon.

The electrophotographic photoreceptor 1 shown in FIG. 9 has a structure in which the conductive support 2 has the undercoating layer 4, the single layer type photosensitive layer 8, and the protective layer 7 sequentially laminated thereon. Moreover, the electrophotographic photoreceptor 1 shown in FIG. 10 has a structure in which the conductive support 2 has the single layer type photosensitive layer 8 and the protective layer 7 sequentially laminated thereon.

In the electrophotographic photoreceptors shown in FIG. 6 to FIG. 10, the undercoating layer 4 and the protective layer 7 are not necessarily provided.

The photosensitive layer of the electrophotographic photoreceptor 1 may be either a single layer type photosensitive layer containing a charge generating material and a charge transporting material in one layer, or a function separation type photosensitive layer in which a layer containing a charge generating material (charge generating layer) and a layer containing a charge transporting material (charge transporting layer) are separately provided. In the case of the function separation type photosensitive layer, regarding the lamination sequence of the charge generating layer and the charge transporting layer, either one may be the upper layer. In the case of the function separation type photosensitive layer, since functions can be separated such that each layer simply has to satisfy each function, higher functions may be realized.

The electrophotographic photoreceptor 1 is not specifically limited, and a publicly known photoreceptor may be applied. Hereunder is a description of respective components based on the electrophotographic photoreceptor 1 shown in FIG. 6 as a representative example.

Examples of the conductive support 2 include a metal plate, a metal drum, and a metal belt formed from a metal or an alloy of aluminum, copper, zinc, stainless steel, chromium, nickel, molybdenum, vanadium, indium, gold, platinum, and the like. Moreover, as the conductive support 2, there may be also used a paper, a plastic film, or a belt which is coated, deposited, or laminated with a conductive compound such as a conductive polymer and indium oxide, or a metal or an alloy of aluminum, palladium, gold, or the like.

In order to prevent interference fringes generated when laser beams are irradiated, the surface of the conductive support 2 is desirably roughened so that the center line average roughness (Ra) is 0.04 μm to 0.5 μm. If the center line average roughness (Ra) of the surface of the conductive support 2 is less than 0.04 μm, the effect of preventing the interference is prone to be insufficient since the surface of the conductive support 2 becomes like a mirror surface. On the other hand, if the center line average roughness (Ra) exceeds 0.5 μm, even if a coating film is formed, the image quality is prone to be insufficient. Using incoherent light for a light source may be suitable for prolonging the service life, since roughening for preventing the interference fringes is not particularly required, and defects generated due to ruggedness on the surface of the conductive support 2 may be prevented.

The method of roughening may be: wet honing in which a polishing agent is suspended in water and sprayed onto the support; centerless grinding in which the support is pressed against a rotating whetstone so as to be continuously ground; anodizing, or the like.

Moreover, as another method of roughening, there is also preferably used a method in which the surface of the conductive support 2 is not roughened, but a conductive or semiconductive powder is dispersed in a resin and a layer is formed on the support surface so as to roughen the surface by the particles dispersed in the layer.

The anodizing is such that aluminum is used as the anode and anodized in an electrolytic solution so as to form an oxide film on the aluminum surface. Examples of the electrolytic solution include a sulfuric acid solution and an oxalic acid solution. However, the porous anodized film, as it stands, is chemically active and easily contaminated, and the resistance greatly varies by the environment. Therefore, sealing is performed in which micropores in the anodized film are closed by means of volume expansion due to a hydration reaction in steam under pressure or boiling water (a metal salt of nickel or the like may be added), so as to change into a more stable hydrous oxide.

The thickness of the anodized film is desirably 0.3 μm to 15 μm. If the film thickness is less than 0.3 μm, the barrier property against the injection is prone to be poor and the effect is prone to be insufficient. On the other hand, if it exceeds 15 μm, the residual potential is prone to be increased by repetitive usage.

Moreover, the conductive support 2 may be subjected to a treatment by an acidic water solution or a boehmite treatment. The treatment by an acidic treatment solution including phosphoric acid, chromic acid, and hydrofluoric acid is performed in the following manner. Firstly, the acidic treatment solution is prepared. The blending proportion of phosphoric acid, chromic acid, and hydrofluoric acid in the acidic treatment solution may be such that phosphoric acid is in a range of 10 weight % to 11 weight %, chromic acid is in a range of 3 weight % to 5 weight %, hydrofluoric acid is in a range of 0.5 weight % to 2 weight %, and the concentration of the total acids thereof is in a range of 13.5 weight % to 18 weight %. The treatment temperature may be 42° C. to 48° C., however the coating film may be further quickly and thickly formed by keeping a high treatment temperature. The thickness of the coating film may be 0.3 μm to 15 μm. If it is less than 0.3 μm, the barrier property against the injection may be poor and the effect is prone to be insufficient. On the other hand, if it exceeds 15 μm, the residual potential is prone to be increased by repetitive usage.

The boehmite treatment can be performed by immersing the support in pure water at 90° C. to 100° C. for 5 minutes to 60 minutes, or bringing the support into contact with heated steam of 90° C. to 120° C. for 5 minutes to 60 minutes. The thickness of the coating film may be 0.1 μm to 5 μm. It may be further anodized with an electrolytic solution having a low solubility with the coating film, such as an adipic acid, a boric acid, a borate salt, a phosphate salt, a phthalate salt, a maleate salt, a benzoate salt, a tartrate salt, and a citrate salt.

The undercoating layer 4 is formed on the conductive support 2. The undercoating layer 4 may include, for example, an organic metal compound and/or a binder resin.

Examples of the organic metal compound include: an organic zirconium compound such as a zirconium chelate compound, a zirconium alkoxide compound, and a zirconium coupling agent; an organic titanium compound such as a titanium chelate compound, a titanium alkoxide compound, and a titanate coupling agent; and an organic aluminum compound such as an aluminum chelate compound and an aluminum coupling agent, as well as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, and an aluminum zirconium alkoxide compound.

In particular, as the organic zirconium compound, there is preferably used an organic zirconium compound, an organic titanium compound, and an organic aluminum compound since the residual potential is low to exhibit good electrophotographic characteristics.

Examples of the binder resins include publicly known resins such as polyvinyl alcohol, polyvinyl methyl ether, poly-N-vinylimidazole, polyethylene oxide, ethyl cellulose, methyl cellulose, an ethylene-acrylic acid copolymer, polyamide, polyimide, casein, gelatin, polyethylene, polyester, a phenolic resin, a vinyl chloride-vinyl acetate copolymer, an epoxy resin, polyvinylpyrrolidone, polyvinylpyridine, polyurethane, polyglutamic acid, and polyacrylic acid. If two or more of these binder resins are used in combination, the blending proportion may be appropriately set as required.

Moreover, the undercoating layer 4 may contain a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, and β-3,4-epoxycyclohexyltrimethoxysilane.

In the undercoating layer 4, an electron transporting pigment may be also mixed/dispersed, from the viewpoint of lowering the residual potential and improving the stability against the environment. Examples of the electron transporting pigment include: an organic pigment such as a perylene pigment, a bisbenzimidazole perylene pigment, a polycyclic quinone pigment, an indigo pigment, and a quinacridone pigment, described in JP-A No. S47-30330; other organic pigments such as a bisazo pigment and a phthalocyanine pigment having an electron attracting substituent such as a cyano group, a nitro group, a nitroso group, and a halogen atom; and an inorganic pigment such as zinc oxide and titanium oxide.

Among these pigments, a perylene pigment, a bisbenzimidazole perylene pigment, a polycyclic quinone pigment, zinc oxide, and titanium oxide may be used since the electron mobility is high.

Moreover, the surface of these pigments may be treated with the above coupling agent, binder resin, or the like in order to control the dispersibility and the charge transporting property.

If the amount of the electron transporting pigment is too much, the strength of the undercoating layer 4 may be decreased to cause defects in the coating film, and thus it is desirably used in an amount of 95 weight % or less, and more desirably 90 weight % or less, based on the total solid amount of the undercoating layer 4.

Moreover, the undercoating layer 4 is desirably added with a fine powder of various organic compounds or inorganic compounds, in order to improve the electrical characteristics, the light scattering property, or the like. In particular: white pigments such as titanium oxide, zinc oxide, zinc white, zinc sulfide, white lead, and lithopone; inorganic pigments serving as an extender pigment such as alumina, calcium carbonate, and barium sulfate; and polytetrafluoroethylene resin particles, benzoguanamine resin particles, styrene resin particles and the like are effective.

The volume average particle diameter of the fine powder to be added is desirably 0.01 μm to 2 μm. The fine powder is added as required, and the dosage thereof is preferably 10 weight % to 90 weight %, and more desirably 30 weight % to 80 weight %, based on the total solid amount of the undercoating layer 4.

The undercoating layer 4 is formed by using an undercoating layer forming coating liquid containing the above respective constituent materials. Any organic solvent may be used for the undercoating layer forming coating liquid as long as it dissolves the organic metal compound and the binder resin and does not cause gelation or aggregation when the electron transporting pigment is mixed and/or dispersed.

Examples of the organic solvent include ordinary solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be solely used, or two or more thereof may be used in a mixture.

The method of mixing/dispersing the respective constituent materials may be an ordinary method using a ball mill, a roll mill, a sand mill, an attritor, a vibratory ball mill, a colloid mill, a paint shaker, ultrasonic waves, or the like. The mixing/dispersing is performed in an organic solvent.

As to the coating method for forming the undercoating layer 4, an ordinary method may be used such as blade coating, wire-bar coating, spray coating, dip coating, bead coating, air knife coating, curtain coating, or the like.

Drying is normally performed at a temperature which allows the solvent to be evaporated and the film to be formed. In particular, since the conductive support 2 which has been subjected to the acidic solution treatment or the boehmite treatment is prone to have an insufficient effect of concealing defects of the base material, the undercoating layer 4 may be formed thereon.

The thickness of the undercoating layer 4 is desirably 0.01 μm to 30 μm, and more desirably 0.05 μm to 25 μm.

The charge generating layer 5 include a charge generating material, and as required, a binder resin.

As the charge generating material, publicly known materials may be used including an organic pigment such as an azo pigment, e.g., bisazo pigment and trisazo pigment, a condensed ring aromatic pigment, e.g., dibromoanthoanthrone, a perylene pigment, a pyrrolopyrrole pigment, and a phthalocyanine pigment, and an inorganic pigment such as trigonal selenium and zinc oxide. The charge generating material may be, in particular when a light source with an exposure wavelength of 380 to 500 nm is used, metal or metal-free phthalocyanine pigment, trigonal selenium, dibromoanthoanthrone, or the like. Among them, hydroxygalliumphthalocyanines disclosed in JP-A No. 5-263007 and JP-A No. 5-279591, chlorogalliumphthalocyanines disclosed in JP-A No. 5-98181, dichlorotinphthalocyanines disclosed in JP-A No. 5-140472 and JP-A No. 5-140473, and titanylphthalocyanines disclosed in JP-A No. 4-189873 and JP-A No. 5-43813 are particularly desirable.

Moreover, among the above hydroxygalliumphthalocyanines, in particular, those having an absorption maximum of 810 nm to 839 nm in absorption spectrum, a primary particle diameter of 0.10 μm or less, and a specific surface area value of 45 $m^2/g$ or more by the BET method are desirable.

The binder resin may be selected from a wide range of insulating resins, and also may be selected from organic photoconductive polymers such as poly-N-vinylcarbazole, polyvinylanthracene, polyvinylpyrene, and polysilane. Desirable examples of the binder resin include insulating resins such as a polyvinylbutyral resin, a polyarylate resin (such as a polycondensation product of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinylalcohol resin, and a polyvinylpyrrolidone resin. However, the binder resin is not limited to these. These binder resins may be solely used, or two or more thereof may be used in a mixture.

The charge generating layer 5 is formed by deposition of a charge generating material, or from a charge generating layer forming coating liquid containing a charge generating material and a binder resin. If the charge generating layer 5 is formed by using a charge generating layer forming coating liquid, the blending ratio (weight ratio) of the charge generating material and the binder resin may be in a range of 10:1 to 1:10.

The method of dispersing the respective constituent materials in the charge generating layer forming coating liquid may be an ordinary method such as a ball mill dispersion method, an attritor dispersion method, and a sand mill dispersion method. At this time, there is required a condition in which the crystal form of the pigment is not changed by the dispersion. Furthermore, at the time of this dispersion, it is effective to use particles having a size of desirably 0.5 μm or less, more desirably 0.3 μm or less, and yet more desirably 0.15 μm or less.

Examples of the solvent used for the dispersion include ordinary organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be solely used, or two or more thereof may be used in a mixture.

The coating method for forming the charge generating layer 5 using the charge generating layer forming coating liquid may be an ordinary method such as blade coating, wire-bar coating, spray coating, dip coating, bead coating, air knife coating, curtain coating, or the like.

The thickness of the charge generating layer 5 is desirably 0.1 μm to 5 μm, and more desirably 0.2 μm to 2.0 μm.

The charge transporting layer 6 includes a charge transporting material and a binder resin, or includes a polymer charge transporting material.

Examples of the charge transporting material includes: electron transporting compounds such as a quinone compound, e.g., p-benzoquinone, chloranil, bromanil, and anthraquinone, a tetracyanoquinodimethane compound, a fluorenone compound, e.g., 2,4,7-trinitrofluorenone, a xanthone compound, a benzophenone compound, a cyanovinyl compound, and an ethylene compound: and hole transporting compounds such as a triarylamine compound, a benzidine compound, an arylalkane compound, an aryl-substituted ethylene compound, a stilbene compound, an anthracene compound, and a hydrazone compound. However, it is not specifically limited to these. These charge transporting materials may be solely used, or two or more thereof may be used in a mixture.

Moreover, the charge transporting material may be a compound represented by the following formulae (a-1), (a-2), or (a-3), from the viewpoint of the mobility.

(a-1)

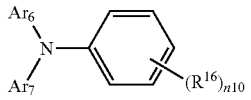

In formula (a-1), $R^{16}$ represents a hydrogen atom or a methyl group, and n10 represents 1 or 2. Moreover, $Ar_6$ and $Ar_7$ each independently represent a substituted or unsubstituted aryl group, $—C_6H_4—C(R^{38})=C(R^{39})(R^{40})$, or $—C_6H_4—CH=CH—CH=C(Ar)_2$. The substituent may be, for example, a halogen atom, an alkyl group having 1 to 5 carbon atoms, an alkoxy group having 1 to 5 carbon atoms, or a substituted amino group substituted with an alkyl group having 1 to 3 carbon atoms. $R^{38}$, $R^{39}$, and $R^{40}$ each independently represent a hydrogen atom, a substituted or unsubstituted alkyl group, or a substituted or unsubstituted aryl group, and Ar represents a substituted or unsubstituted aryl group.

(a-2)

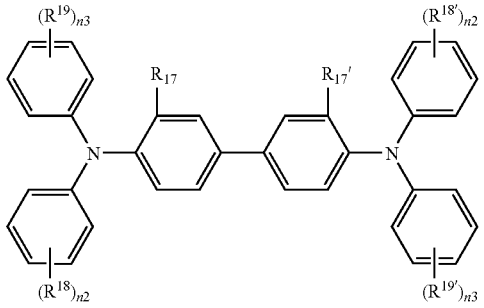

In formula (a-2), $R^{17}$ and $R^{17'}$ each independently represent a hydrogen atom, a halogen atom, an alkyl group having 1 to 5 carbon atoms, or an alkoxy group having 1 to 5 carbon atoms. $R^{18}$, $R^{18'}$, $R^{19}$, and $R^{19'}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{38})=C(R^{39})(R^{40})$, or $—CH=CH—CH=C(Ar)_2$. $R^{38}$, $R^{39}$, and $R^{40}$ each independently represent a hydrogen atom, a substituted or unsubstituted alkyl group, or a substituted or unsubstituted aryl group. Ar represents a substituted or unsubstituted aryl group. Moreover, n2 and n3 each independently represent an integer of 0 to 2.

(a-3)

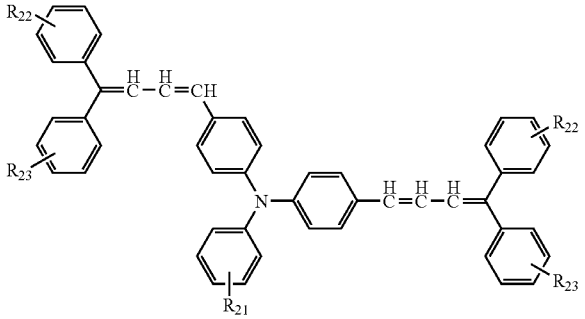

In formula (a-3), $R_{21}$ represents a hydrogen atom, an alkyl group having 1 to 5 carbon atoms, an alkoxy group having 1 to 5 carbon atoms, a substituted or unsubstituted aryl group, or $—CH=CH—CH=C(Ar)_2$. Ar represents a substituted or unsubstituted aryl group. $R_{22}$ and $R_{23}$ each independently represent a hydrogen atom, a halogen atom, an alkyl group having 1 to 5 carbon atoms, an alkoxy group having 1 to 5 carbon atoms, an amino group substituted with an alkyl group having 1 or 2 carbon atoms, or a substituted or unsubstituted aryl group.

Examples of the binder resin used for the charge transporting layer 6 include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, and a styrene-alkyd resin. These binder resins may be solely used, or two or more thereof may be used in a mixture. The blending ratio (weight ratio) of the charge transporting material and the binder resin may be 10:1 to 1:5.

Moreover, as the polymer charge transporting material, publicly known charge transporting materials may be used such as poly-N-vinylcarbazole and polysilane. In particular, the polyester based polymer charge transporting materials disclosed in JP-A No. 8-176293 and JP-A. No. 8-208820 are particularly desirable since they have a high charge transporting property.

The polymer charge transporting material may be used by itself as the constituent material of the charge transporting layer 6, and may be mixed with the binder resin to form a film.

The charge transporting layer 6 is formed by using a charge transporting layer forming coating liquid containing the constituent materials as mentioned above.

Examples of the solvent for the charge transporting layer forming coating liquid include ordinary organic solvents such as: aromatic hydrocarbons, e.g., benzene, toluene, xylene, and chlorobenzene; ketones, e.g., acetone and 2-butanone; halogenated aliphatic hydrocarbons, e.g., methylene chloride, chloroform, and ethylene chloride; and cyclic or linear ethers, e.g., tetrahydrofuran and ethyl ether. These may be solely used, or two or more thereof may be used in a mixture.

The coating method of the charge transporting layer forming coating liquid may be an ordinary method such as blade coating, wire-bar coating, spray coating, dip coating, bead coating, air knife coating, curtain coating, or the like.

The thickness of the charge transporting layer 6 is desirably 5 μm to 50 μm, and more desirably 10 μm to 30 μm.

In the photosensitive layer 3, an additive such as an antioxidant, a photostabilizer, and a thermal stabilizer may be added, in order to prevent deterioration of the photoreceptor due to ozone or an oxidizing gas generated in the image forming apparatus, or light or heat.

Examples of the antioxidant include hindered phenol, hindered amine, paraphenylendiamin, arylalkane, hydroquinone, spirochromane, and spiroindanone, and derivatives thereof, an organic sulfur compound, and an organic phosphoric compound. Examples of the photostabilizer include derivatives of benzophenone, benzotriazole, dithiocarbamate, tetramethylpiperidine, and the like.

Moreover, the photosensitive layer 3 may contain at least one type of electron accepting substance, in order to improve the sensitivity, to reduce the residual potential, and to reduce the fatigue due to repetitive usage.

Examples of the electron accepting substance include, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these, fluorenone compounds, quinone compounds, and benzene derivatives having an electron-attracting substituent such as Cl, CN, and $NO_2$ are particularly desirable.

The protective layer 7 may include any one of the following resins, for example.

As the resin, there may be used polymer charge transporting materials such as a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin a styrene-alkyd resin, poly-N-vinylcarbazole, polysilane, and polyester-based polymer charge transporting materials disclosed in JP-A No. 8-176293 and JP-A. No. 8-208820. Among these, thermosetting resins such as a phenolic resin, a thermosetting acrylic resin, a thermosetting silicone resin, an epoxy resin, a melamine resin, a urethane resin, a polyimide resin, and a polybenzimidazole resin are desirable. Among these, in particular, a phenolic resin, a melamine resin, a benzoguanamine resin, a siloxane resin, and a urethane resin are preferably used. A coating liquid containing these resins or the precursor thereof as a main component is coated, then in the step of drying the solvent, a heat treatment is concurrently performed, thereby curing the coating liquid to form an insoluble cured film.

Examples of the phenolic resin include a monomer of phenols such as monomethylolphenols, dimethylolphenols, and trimethylolphenols, the mixture of these monomers, oligomers thereof, and the mixture of these monomers and oligomers. Such a phenolic resin can be obtained by reacting a compound having a phenolic structure such as: resorcine; bisphenol; substituted phenols having one hydroxyl group, e.g., phenol, cresol, xylenol, paraalkylphenol, and paraphenylphenol; substituted phenols having two hydroxyl groups, e.g., catechol, resorcinol, and hydroquinone; bisphenols, e.g., bisphenol A and bisphenol Z; and biphenols; with a compound such as formaldehyde and paraformaldehyde, under the presence of an acidic catalyst or an alkali catalyst. As the phenolic resin, commercially available phenolic resins may be used. Moreover, as the phenolic resin, a resol type phenolic resin is desirable. In the present specification, a relatively large molecule having about 2 to 20 repetitive molecular structural units is referred to as an oligomer, and a molecule smaller than the above molecule is referred to as a monomer.

As the acidic catalyst, a sulfuric acid, a paratoluene sulfonic acid, a phosphoric acid, or the like is used. Moreover, as the alkali catalyst, a hydroxide of an alkali metal or an alkali earth metal such as NaOH, KOH, $Ca(OH)_2$, $Ba(OH)_2$, or an amine catalyst is used.

Examples of the amine catalyst include ammonia, hexamethylenetetramine, trimethylamine, triethylamine, and triethanolamine. However, the amine catalyst is not limited to these. If a basic catalyst is used, the carrier is remarkably trapped by residual catalyst, and the electrophotographic characteristic is prone to be worsened. Therefore, the basic catalyst may be neutralized with an acid, or may be deactivated or removed by bringing into contact with an ion-exchange resin or an absorbent such as silicagel.

As to the melamine resin and the benzoguanamine resin, various types may be used such as a methylol type having a methylol group as it is, a full ether type having all methylol groups alkyletherificated, a full imino type, and a mixed type of methylol and imino groups. Among these, from the viewpoint of coating liquid stability, the ether type may be used.

As the urethane resin, there may be used a polyfunctional isocyanate, an isocyanurate, a blocked isocyanate having such a polyfunctional isocyanate or an isocyanurate blocked with alcohol or ketone, or the like. Among these, from the viewpoint of coating liquid stability, the blocked isocyanate or the isocyanurate may be used. These are desirable since they are cross-linked with additives for the electrophotographic photoreceptor of an aspect of the present invention under heating.

As the silicone resin, there may be used a resin derived from compounds represented by the following formula (X) or the like.

These resins may be solely used, or two or more thereof may be used in a mixture.

In the protective layer 7, conductive particles may be added in order to reduce the residual potential. Examples of the conductive particles include metals, metal oxides, and carbon black. Among these, metals or metal oxides are more desirable. Examples of the metals include aluminum, zinc, copper, chromium, nickel, silver, and stainless steel, and plastic particles having these metals deposed on the surface thereof. Examples of the metal oxides include zinc oxide, titanium oxide, tin oxide, antimony oxide, indium oxide, bismuth oxide, indium oxide doped with tin, tin oxide doped with antimony or tantalum, and zirconium oxide doped with antimony. These may be solely used, or two or more thereof may be used in combination. When two or more thereof are used in combination, they may be simply mixed, or may be in the form of a solid solution or fusion. The average diameter of the conductive particles is preferably 0.3 μm or less, and particularly desirably 0.1 μm or less, from the viewpoint of transparency of the protective layer 7.

In the curable resin composition for forming the protective layer 7, a compounds represented by the following formula (X) may be added, in order to control various physical properties such as the strength and the film resistance of the protective layer 7.

$$Si(R^{50})_{(4-c)}Q_c \quad (X)$$

In formula (X), $R^{50}$ represents a hydrogen atom, an alkyl group, or a substituted or unsubstituted aryl group, Q represents a hydrolyzable group, and c represents an integer of 1 to 4.

Specific examples of the compounds represented by formula (X) include the following silane coupling agents. Examples of the silane coupling agents include: tetrafunctional alkoxysilane (c=4) such as tetramethoxysilane and tetraethoxysilane; trifunctional alkoxysilane (c=3) such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, 1H,1H,2H,2H-perfluorooctyltriethoxysilane; bifunctional alkoxysilane (c=2) such as dimethyldimethoxysilane, diphenyldimethoxysilane, and methylphenyldimethoxysilane; and monofunctional alkoxysilane (c=1) such as trimethylmethoxysilane. In order to improve the strength of the film, trifunctional or tetrafunctional alkoxysilane may be used. In order to improve the flexibility and the film forming property, monofunctional or bifunctional alkoxysilane may be used.

A silicone hard coating agent mainly formed from these coupling agents may be used. As a commercially available hard coating agent, there may be used KP-85, X-40-9740, and X-40-2239 (manufactured by Shin-Etsu Chemical Co., Ltd.), and AY42-440, AY42-441, and AY49-208 (manufactured by Dow Corning Toray Co. Ltd.).

In the curable resin composition for forming the protective layer 7, a compound having two or more silicon atoms as shown in the following formula (XI) may be used in order to improve the strength of the protective layer 7.

$$B—(Si(R^{51})_{(3-d)}Q_d)_2 \quad (XI)$$

In formula (XI), B represents a divalent organic group, $R^{51}$ represents a hydrogen atom, an alkyl group, or a substituted or unsubstituted aryl group, Q represents a hydrolyzable group, and d represents an integer of 1 to 3.

More specifically, desirable examples of the compound represented by the above formula (XI) include the following compounds (XI-1) to (XI-16). Me represents a methyl group, and Et represents an ethyl group.

TABLE 1

XI-1 $(MeO)_3Si—(CH_2)_2—Si(OMe)_3$
XI-2 $(MeO)_2MeSi—(CH_2)_2—SiMe(OMe)_2$
XI-3 $(MeO)_2MeSi—(CH_2)_6—SiMe(OMe)_2$
XI-4 $(MeO)_3Si—(CH_2)_6—Si(OMe)_3$
XI-5 $(EtO)_3Si—(CH_2)_6—Si(OEt)_3$
XI-6 $(MeO)_2MeSi—(CH_2)_{10}—SiMe(OMe)_2$
XI-7 $(MeO)_3Si—(CH_2)_3—NH—(CH_2)_3—Si(OMe)_3$
XI-8 $(MeO)_3Si—(CH_2)_3—NH—(CH_2)_2—NH—(CH_2)_3—Si(OMe)_3$

XI-9

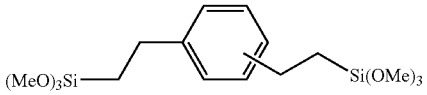

XI-10

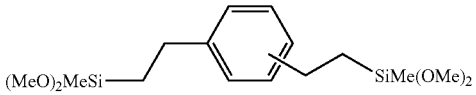

XI-11

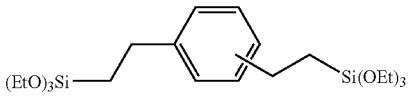

XI-12

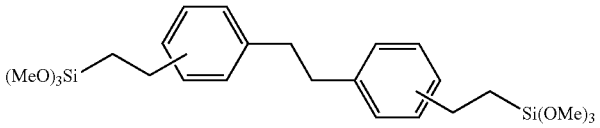

XI-13

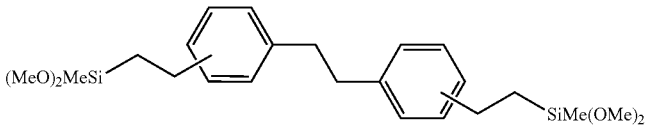

XI-14

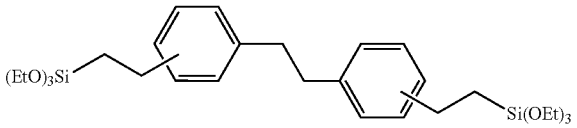

XI-15 $(MeO)_3SiC_3H_6—O—CH_2CH\{—O—C_3H_6Si(OMe)_3\}—CH_2\{—O—C_3H_6Si(OMe)_3\}$
XI-16 $(MeO)_3SiC_2H_4—SiMe_2—O—SiMe_2—O—SiMe_2—C_2H_4Si(OMe)_3$

Furthermore, in order to control the film characteristics and to prolong the liquid life, a resin soluble in an alcohol or ketone solvent may be added. Examples of such a resin include a polyvinylbutyral resin, a polyvinylformal resin, a partially acetalized polyvinylacetal resin having a part of butylal modified by formal, acetoacetal, or the like (for example, S-LEC B, and K manufactured by Sekisui Chemical Company, Limited), a polyamide resin, a cellulose resin, and a phenolic resin. In particular, from the viewpoint of improving the electrical characteristics, a polyvinylacetal resin is desirable.

Moreover, various resins may be added in order to control the electric discharging gas resistance, the mechanical strength, the scratch resistance, the particle dispersibility, and the viscosity, to decrease the torque, to control the amount of abrasion, to prolong the pot life, and the like. In the present exemplary embodiment, a resin soluble in alcohol may further be added. Examples of the resin soluble in an alcohol solvent include a polyvinylbutyral resin, a polyvinylformal resin, a partially acetalized polyvinylacetal resin having a part of butylal modified by formal, acetoacetal, or the like (for example, S-LEC B, and K manufactured by Sekisui Chemical Company, Limited), a polyamide resin, and a cellulose resin. In particular, from the viewpoint of improving the electrical characteristics, a polyvinylacetal resin may be used.

The weight average molecular weight of the above resin is preferably 2000 to 100000, and more desirably 5000 to 50000. If the weight average molecular weight is less than 2000, a desired effect is prone to be unobtainable. If it is more than 100000, the solubility is prone to be lowered, limiting the dosage, or causing defects of film formation at the time of coating. The dosage is preferably 1 weight % to 40 weight %, more desirably 1 weight % to 30 weight %, and yet more desirably 5 weight % to 20 weight %. If the dosage is less than 1 weight %, a desired effect is difficult to obtain. If it is more than 40 weight %, image blurring may be easily generated in high temperature and high humidity. The above resins may be used, or two or more thereof may be used in a mixture.

Moreover, in order to prolong the pot life and to control the film characteristics, a cyclic compound having a repetitive structure unit represented by the formula (XII), or the derivative of such a compound may be contained therein.

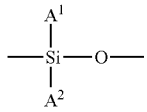

(XII)

In formula (XII), $A^1$ and $A^2$ each independently represent a monovalent organic group.

Examples of the cyclic compound having the repetitive structure unit represented by formula (XII) include a commercially available cyclic siloxane. Specific examples of the cyclic siloxane include: cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine atom-containing cyclosiloxanes such as 3-(3,3,3-trifluoropropyl)methylcyclotrisiloxane; hydrosilyl group containing cyclosiloxanes such as a mixture of methylhydrosiloxane, pentamethylcyclopentasiloxane, and phenylhydrocyclosiloxane; and a vinyl group containing cyclosiloxanes such as pentavinylpentamethylcyclopentasiloxane. These cyclic siloxane compounds may be used, or two or more thereof may be used in a mixture.

Furthermore, in order to control the dirt adhesion resistance, the lubricity, and the hardness of the surface of the electrophotographic photoreceptor, various particles may be added to the curable resin composition for forming the protective layer 7.

One example of the particles includes a silicon atom-containing particle. The silicon atom-containing particle means a particle containing silicon in the constituent elements, and specific examples thereof include colloidal silica and a silicone particle. The colloidal silica used as the silicon atom-containing particle is selected from those having a volume average particle diameter of desirably 1 nm to 100 nm, and more desirably 10 nm to 30 nm, and is dispersed in an acidic or alkaline aqueous dispersion or an organic solvent such as alcohol, ketone, and ester. Commercially available silicon atom-containing particles may be used. The solid content of the colloidal silica in the curable resin composition is not specifically limited, however it is desirably in a range of 0.1 weight % to 50 weight %, and more desirably a range of 0.1 weight % to 30 weight %, based on the total solid amount in the curable resin composition, in terms of the film forming property, the electrical characteristics, and the strength.

The silicone particle used as the silicon atom-containing particle is selected from a silicone resin particle, a silicone rubber particle, and a silica particle having the surface treated with silicone, which are in a spherical shape and have a volume average particle diameter of desirably 1 nm to 500 nm, and more desirably 10 nm to 100 nm. Commercially available silicone particles may be used.

The silicone particle is a particle of a small diameter that is chemically inactive and superior in the dispersibility into a resin, and the required contents thereof may be small in order to obtain satisfactory characteristics. Therefore, the surface properties of the electrophotographic photoreceptor may be improved without interfering with the crosslink reaction. That is, in a state where the silicone particles are evenly taken into a strong crosslink structure, the lubricity and the water repelling property of the surface of the electrophotographic photoreceptor may be improved, and satisfactory abrasion resistance and dirt adhesion resistance may be kept for a long time. The content of the silicone particle in the curable resin composition is desirably in a range of 0.1 weight % to 30 weight %, and more desirably a range of 0.5 weight % to 10 weight %, based on the total solid amount in the curable resin composition.

Moreover, examples of other particles include: fluoro-particles such as tetrafluoroethylene, trifluoroethylene, hexafluoropropylene, vinyl fluoride, vinylidene fluoride, and the like; particles formed from a copolymer resin obtained by copolymerization of a fluororesin and monomers having a hydroxyl group as described in "Proceedings of Lectures of the 8th Polymer Materials Forum p. 89"; and semiconductive metal oxide such as $ZnO—Al_2O_3$, $SnO_2—Sb_2O_3$, $In_2O_3—SnO_2$, $ZnO—TiO_2$, $ZnO—TiO_2$, $MgO—Al_2O_3$, $FeO—TiO_2$, $TiO_2$, $SnO_2$, $In_2O_3$, ZnO, and MgO.

Moreover, in order to control the dirt adhesion resistance, the lubricity, the hardness or the like of the surface of the electrophotographic photoreceptor, oil such as silicone oil may be added. Examples of the silicone oil include silicone oils such as dimethylpolysiloxane, diphenylpolysiloxane, and phenylmethylsiloxane; and reactive silicone oils such as amino modified polysiloxane, epoxy modified polysiloxane, carboxyl modified polysiloxane, carbinol modified polysiloxane, methacrylic modified polysiloxane, mercapto modified polysiloxane, and phenol modified polysiloxane. These may be previously added in the curable resin composition for forming the protective layer 7, or may be impregnated under a reduced pressure or a pressurized condition after forming the photoreceptor.

Furthermore, additives such as a plasticizer, a surface modifier, an antioxidant, and a photoantidegradant may be added. Examples of the plasticizer include biphenyl, chlorinated biphenyl, terphenyl, dibutylphthalate, diethylene glycol phthalate, dioctylphthalate, triphenyl phosphate, methylnaphthalene, benzophenone, chlorinated paraffin, polypropylene, polystyrene, and various fluorocarbon hydrogens.

An antioxidant having a substructure of hindered phenol, hindered amine, thioether, or phosphite may be added, which is effective for improving the potential stability and the image quality under environmental changes.

Examples of the antioxidant include the following compounds: a hindered phenol type such as "SUMILIZER BHT-R", "SUMILIZER MDP-S", "SUMILIZER BBM-S", "SUMILIZER WX-R", "SUMILIZER NW", "SUMILIZER BP-76", "SUMILIZER BP-101", "SUMILIZER GA-80", "SUMILIZER GM", and "SUMILIZER GS" manufactured by SUMITOMO CHEMICAL CO., LTD, "IRGANOX 1010", "IRGANOX 1035", "IRGANOX 1076", "IRGANOX 1098", "IRGANOX 1135", "IRGANOX 1141", "IRGANOX 1222", "IRGANOX 1330", "IRGANOX 1425WL", "IRGANOX 1520L", "IRGANOX 245", "IRGANOX 259", "IRGANOX 3114", "IRGANOX 3790", "IRGANOX 5057", and "IRGANOX 565" manufactured by Ciba Specialty Chemicals Co., Ltd., "ADEKASTAB AO-20", "ADEKASTAB AO-30", "ADEKASTAB AO-40", "ADEKASTAB AO-50", "ADEKASTAB AO-60", "ADEKASTAB AO-70", "ADEKASTAB AO-80", and "ADEKASTAB AO-330" manufactured by Asahi Denka Kogyo KK; a hindered amine type such as "SANOL LS2626", "SANOL LS765", "SANOL LS770", and "SANOL LS744" manufactured by Sankyo Lifetech Co., Ltd., "TINUVIN 144", "TINUVIN 622LD" manufactured by Ciba Specialty Chemicals Co., Ltd., "MARK LA57", "MARK LA67", "MARK LA62", "MARK LA68", and "MARK LA63" manufactured by Asahi Denka Kogyo KK; a thioether type such as "SUMILIZER TPS" manufactured by SUMITOMO CHEMICAL CO., LTD; and a phosphite type such as "MARK 2112", "MARK PEP•8", "MARK PEP•24G", "MARK PEP•36", "MARK 329K", and "MARK HP•10" manufactured by Asahi Denka Kogyo KK. In particular, a hindered phenol type antioxidant and a hindered amine type antioxidant is desirable. Furthermore, these may be modified by a substituent capable of a cross-linking reaction with a material for forming a crosslinked film, such as an alkoxysilyl group.

Furthermore, in order to remove the catalyst for synthesizing from a resin having a crosslink structure such as a phenolic resin, a melamine resin, and a benzoguanamine resin, the resin may be dissolved in an appropriate solvent such as methanol, ethanol, toluene, or ethyl acetate, and then subjected to a treatment such as washing with water and reprecipitation using a poor solvent, or a treatment using the following materials. Examples of such a material include: a cation exchange resin such as AMBERLITE 15, AMBERLITE 200C, and AMBERLYST 15E (manufactured by Rohm & Haas Corp.), DOWEX MWC-1-H, DOWEX 88, and DOWEX HCR-W2 (manufactured by Dow Chemical Inc.), LEWATIT SPC-108 and LEWATIT SPC-118 (manufactured by Bayer AG), DIAION RCP-150H (manufactured by Mitsubishi Kasei Corp.), SUMIKAION KC-470, DUOLITE C26-C, DUOLITE C-433, and DUOLITE-464 (manufactured by Sumitomo Chemical Co., Ltd.), and NAFION-H (manufactured by Du Pont Company); an anion exchange resin such as AMBERLITE IRA-400 and AMBERLITE IRA-45 (manufactured by Rohm & Haas Corp.); inorganic solids to whose surfaces protonic acid group-containing groups are bonded, such as $Zr(O_3PCH_2CH_2SO_3H)_2$ and $Th(O_3PCH_2CH_2COOH)_2$; polyorganosiloxane containing a protonic acid group, such as polyorganosiloxane having a sulfonic acid group; heteropolyacids such as cobalt tungstic acid and phosphorous molybdic acid; isopolyacids such as niobic acid, tantalic acid and molybdic acid; unitary metal oxides such as silica gel, alumina, chromia, zirconia, CaO and MgO; complex metal oxides such as silica-alumina, silica-magnesia, silica-zirconia, and zeolite; clay minerals such as acid clay, activated clay, montmorillonite, and kaolinite; metal sulfates such as $LiSO_4$ and $MgSO_4$; metal phosphates such as zirconium phosphate and lanthanum phosphate; metal nitrates such as $LiNO_3$ and $Mn(NO_3)_2$; inorganic solids to whose surfaces amino group-containing groups are bonded, such as a solid obtained by reacting aminopropyltriethoxysilane on silica gel; and polyorganosiloxane containing an amino group, such as an amino-modified silicone resin.

Moreover, in order to adjust the film characteristics such as the hardness, the adhesiveness, and the flexibility, there may be added: an epoxy containing compound such as polyglycidylmethacrylate, glycidylbisphenols, and a phenol epoxy resin; a terephthalic acid, a maleic acid, a pyromellitic acid, a biphenyltetracarboxylic acid and the like; and the anhydrides thereof. The dosage thereof is desirably 0.05 to 1 weight parts, and more desirably 0.1 to 0.7 weight parts, based on 1 weight part of additives for the electrophotographic photoreceptor of an aspect of the present invention.

Furthermore, an insulating resin such as a polyvinylbutyral resin, a polyarylate resin (such as a polycondensation product of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinylalcohol resin, and a polyvinylpyrrolidone resin may be mixed at a desired proportion. As a result, defects of the coated film due to heat contraction, cissing, or adhesiveness with the charge transporting layer 6, may be suppressed.

The protective layer 7 is formed by using a protective layer forming coating liquid containing the above respective constituent materials. That is, the protective layer 7 may be formed by coating and curing the protective layer forming coating liquid on the charge transporting layer 6.

In the protective layer forming coating liquid, a solvent may be used as required, such as: alcohols, e.g., methanol, ethanol, propanol, and butanol; ketones, e.g., methylethylketone; tetrahydrofuran; and ethers, e.g., diethylether and dioxane. Other various solvents may also be used. However, in order to apply dip coating generally used for the production of the electrophotographic photoreceptor, an alcohol type or ketone type solvent or the mixed solvent thereof may be used. Moreover, solvents having a boiling point of 50 to 150° C. are preferred. The solvents may be arbitrarily mixed for use. The amount of the solvent may be arbitrarily set. However, if the amount of the solvent is too small, precipitation may easily occur. Therefore, the amount of the solvent is preferably 0.5 to 30 weight parts, and more desirably 1 to 20 weight parts, based on 1 weight part of the total solid amount contained in the protective layer forming coating liquid.

Furthermore, a curing catalyst may be used in the protective layer forming coating liquid, for crosslinking. Preferred examples of the curing catalyst include: bissulfonyldiazomethanes such as bis(isopropylsulfonyl)diazomethane; bissulfonylmethanes such as methylsulfonyl p-toluene sulfonylmethane; sulfonylcarbonyldiazomethanes such as cyclohexylsulfonylcyclohexylcarbonyldiazomethane; sulfonylcarbonyl alkanes such as 2-methyl-2-(4-methylphenylsulfonyl)propiophenone; nitrobenzylsulfonates such as 2-nitrobenzyl p-toluene sulfonate; alkyl sulfonates and aryl sulfonates such as pyrogallol trismethanesulfonate; benzoinsulfonates such as (g) benzointosylate; N-sulfonyloximides such as N-(trifluoromethylsulfonyloxy)phthalimido; pyridones such as (4-fluorobenzenesulfonyloxy)-3,4,6-trimethyl-2-pyridone; sulfonic acid esters such as 2,2,2-trifluoro-1-trifluoromethyl-1-(3-vinylphenyl)-ethyl-4-chlorobenzenesulfonate; a photoacid generator such as an onium salt, e.g., triphenylsulfonium methanesulfonate and diphenyliodonium trifluoromethanesulfonate; a compound prepared by neutralizing a proton acid or a Lewis acid with a Lewis base; a mixture of a Lewis acid and trialkylphosphate; sulfonic acid esters; phosphoric acid esters; an onium compound; and a carboxylic acid anhydride compound.

Examples of the compound prepared by neutralizing a proton acid or a Lewis acid with a Lewis base include: a compound prepared by neutralizing a halogenocarboxylic acid, a sulfonic acid, a monoester of sulfuric acid, a monoester of phosphoric acid, a diester of phosphoric acid, an ester of polyphosphoric acid, a monoester of boric acid, or a diester of boric acid with an amine such as ammonia, monoethylamine, triethylamine, pyridine, piperidine, aniline, morpholine, cyclohexylamine, n-butylamine, monoethanolamine, diethanolamine, and triethanolamine, or trialkylphosphine, triaryl phosphine, trialkyl phosphite, or triarylphosphite; and commercially available acid-base blocked catalysts such as NACURE 2500X, 4167, X-47-110, 3525, and 5225 (Product Names: manufactured by King Industries Co., Ltd.). Examples of the compound prepared by neutralizing a Lewis acid with a Lewis base include compounds prepared by neutralizing a Lewis acid such as $BF_3$, $FeCl_3$, $SnCl_4$, $AlCl_3$, and $ZnCl_2$ with a Lewis base described above.

Examples of the onium compound include triphenylsulfoniummethanesulfonate and diphenyliodoniumtrifluoromethanesulfonate.

Examples of the carboxylic acid anhydride compound include acetic anhydride, propionic anhydride, butyric anhydride, isobutyric anhydride, lauric anhydride, oleic anhydride, stearic anhydride, n-caproic anhydride, n-caprylic anhydride, n-capric anhydride, palmitic anhydride, myristic anhydride, trichloroacetic anhydride, dichloroacetic anhydride, monochloroacetic anhydride, trifluoroacetic anhydride, and heptafluorobutyric anhydride.

Specific examples of the Lewis acid include: metal halides such as boron trifluoride, aluminum trichloride, titanium trichloride, titanium tetrachloride, ferrous chloride, ferric chloride, zinc chloride, zinc bromide, stannous chloride, stannic chloride, stannous bromide, and stannic bromide; organic metal compounds such as trialkylboron, trialkylaluminum, dialkylaluminum halides, monoalkylalminium halides and tetraalkyltin; metallic chelate compounds such as diisopropoxyethylacetoacetate aluminum, tris(ethylacetoacetate)aluminum, tris(acetylacetonato)aluminum, diisopropoxy bis(ethylacetoacetate)titanium, diisopropoxy bis(acetylacetonato)titanium, tetrakis(n-propylacetoacetate)zirconium, tetrakis(acetylacetonato)zirconium, tetrakis(ethylacetoacetate)zirconium, dibutyl bis(acetylacetonato)tin, tris(acetylacetonato)iron, tris(acetylacetonato)rhodium, bis(acetylacetonato)zinc, and tris(acetylacetonato)cobalt; and metallic soaps such as dibutyltin dilaurate, dioctyltin ester maleate, magnesium naphthenate, calcium naphthenate, manganese naphthenate, iron naphthenate, cobalt naphthenate, copper naphthenate, zinc naphthenate, zirconium naphthenate, lead naphthenate, calcium octylate, manganese octylate, iron octylate, cobalt octylate, zinc octylate, zirconium octylate, tin octylate, lead octylate, zinc laurate, magnesium stearate, aluminum stearate, calcium stearate, cobalt stearate, zinc stearate, and lead stearate. These may be solely used, or two or more thereof may be used in combination.

The dosage of these catalysts is not specifically limited. However, it is preferably 0.1 to 20 weight parts, and particularly preferably 0.3 to 10 weight parts, based on 100 weight parts of the total solid amount contained in the protective layer forming coating liquid.

The coating method for coating the protective layer forming coating liquid on the charge transporting layer 6 may be an ordinary method such as blade coating, wire-bar coating, spray coating, dip coating, bead coating, air knife coating, curtain coating, or the like. Then, after the coating, the coated film is dried to form the protective layer 7.

At the time of coating, if a necessary film thickness is not obtained by one time coating, the necessary film thickness can be obtained by repeated coatings for multiple times. If repeated coatings are performed for multiple times, a heat treatment may be performed at each time of coating, or may be performed after the repeated coatings for multiple times.

If the protective layer 7 is formed by using a resin having a crosslink structure, the curing temperature is desirably 100 to 170° C., and more desirably 100 to 160° C. at the time of crosslinking. Moreover, the curing time is desirably 30 minutes to 2 hours, and more desirably 30 minutes to 1 hour, and the heating temperature may be changed in multi steps.

Regarding the atmosphere for performing the crosslinking reaction, the electrical characteristics may be prevented from being worsened by performing the reaction under an atmosphere of a so-called inactive gas against oxidation, such as nitrogen, helium, and argon. If the crosslinking reaction is performed under an inactive gas atmosphere, the curing temperature can be set higher than that of the air atmosphere, and the curing temperature is desirably 100 to 180° C., and more desirably 110 to 160° C. Moreover, the curing time is desirably 30 minutes to 2 hours, and more desirably 30 minutes to 1 hour.

The thickness of the protective layer 7 is preferably 0.5 to 15 μm, more preferably 1 to 10 μm, and yet more preferably 1 to 5 μm.

The oxygen permeability coefficient of the protective layer 7 at 25° C. is preferably $4\times10^{12}$ fm/s·Pa or less, more preferably $3.5\times10^{12}$ fm/s·Pa or less, and yet more preferably $3\times10^{12}$ fm/s·Pa or less.

Here, the oxygen permeability coefficient is an index showing the readiness of oxygen gas permeation into a layer. However, from a different point of view, it can be considered as a substitutional characteristic of a physical clearance ratio in the layer. Although the absolute value of the permeability coefficient differs as the type of gas changes, the magnitude correlation between layers serving as a specimen is hardly reversed. Consequently, the oxygen permeability coefficient may be interpreted as an index showing the readiness of general gas permeation.

That is, if the oxygen permeability coefficient of the protective layer 7 at 25° C. satisfies the above condition, gas hardly permeates into the protective layer 7. Consequently, permeation of an electric discharge product generated during the image formation process may be suppressed, deterioration of compounds contained in the protective layer 7 may be suppressed, and the electrical characteristics may be kept at a high standard, which is effective for improving the image quality and prolonging the service life.

If a single layer type photosensitive layer is used in the electrophotographic photoreceptor 1, a single layer type photosensitive layer contains a charge generating material and a binder resin. For the charge generating material, a similar material to that used for the charge generating layer in the function separation type photosensitive layer may be used. For the binder resin, a similar binder resin to that used for the charge generating layer and the charge transporting layer in the function separation type photosensitive layer may be used. The content of the charge generating material in the single layer type photosensitive layer is desirably 10 to 85 weight %, and more desirably 20 to 50 weight %, based on the total solid amount in the single layer type photosensitive layer. In the single layer type photosensitive layer, a charge transporting material or a polymer charge transporting material may be added, in order to improve the photoelectronic property, or the like. The dosage thereof is desirably 5 to 50 weight % based on the total solid amount in the single layer type photosensitive layer. Moreover, the solvent used for coating, and the coating method may be similar to those for the above respective layers. The thickness of the single layer type photosensitive layer is preferably about 5 to 50 μm, and more preferably 10 to 40 μm.

Next is a description of the developing device 25. The developing device 25 is to develop an electrostatic latent image on the electrophotographic photoreceptor 1 so as to form a toner image.

A toner used for the developing device 25 is described. If the cleaning roller of embodiment A of an aspect of the present invention is used, such a toner may have an average shape factor SF1 of 100 to 140 ($SF1=ML^2/A\times\pi/4\times100$, wherein ML represents a maximum length of the particle, and A represents a projected area of the particle). The average shape factor (SF1) can be obtained such that: the image of the toner particle on a slide glass is measured through a video camera, with an optical microscope, and is taken into an image analyzer (LUZEX III manufactured by Nireco Corp.), so as to calculate the maximum length (ML) and the projected area (A) of the toner, which are then substituted into the above equation to obtain a shape factor. The average shape factor is an average value of shape factors calculated by the above equation for arbitrary 100 toner particles. Furthermore, if the cleaning roller of embodiment A of an aspect of the present invention is used, the toner may have a volume average particle diameter of 2 μm to 12 μm, more preferably 3 μm to 12 μm, and yet more preferably 3 μm to 9 μm. By using such a toner satisfying the above ranges of the average shape factor and volume average particle diameter, a high developing property, a high transferring property, and a high quality image may be obtained.

If the cleaning roller of embodiment B of an aspect of the present invention is used, the toner may have an average shape factor SF1 of 110 to 135. The average shape factor shows a degree of roundness of the toner. As the shape is more rounded, transfer residue of toner slipping through the cleaning blade is increased, which may increase the contamination of the charging roller. On the contrary, if the shape is too indeterminate, the transferring property may be decreased, and the transfer residue of toner may be increased, which may increase the contamination of the charging roller.

Furthermore, if the cleaning roller of embodiment B of an aspect of the present invention is used, the toner preferably may have a volume average particle diameter of 5 μm to 10 μm. If this volume average diameter is too small, transfer residue of toner slipping through the cleaning blade may be increased, which may increase the contamination of the charging roller. In addition, the fluidity of the toner may be worsened and a sufficient charging ability may not be easily applied from the carrier, which may cause fogging on the background and decrease in the density reproducibility. Moreover, if the volume average diameter is too large, as a result, the particle diameter distribution is enlarged, and thus the distribution of the charging amount of toner becomes nonuniform, increasing the toner having the reversed polarity, which may easily cause a problem of increasing the contamination of the charging roller, and may worsen the reproducibility of fine dots and gradation property.

The toner is not particularly limited by the production method. Examples of a method of producing the toner which may be used include: a kneading-pulvelizing method in which a mixture of a binder resin, a colorant, a releasing agent and, as required, a charge controlling agent and the like are kneaded, pulvelized, and classified; a method in which the particle obtained by a kneading-pulvelizing method is changed in shape by mechanical impact or thermal energy; an emulsion polymerization coagulating method in which a polymerizable monomer of a binder resin is emulsion-polymerized to obtain a dispersion liquid, the dispersion liquid thus obtained is mixed with a dispersion liquid containing a colorant, a releasing agent and as required, a charge controlling agent, and the mixture is coagulated and fused under heating to obtain toner particles; a suspension polymerization method in which a polymerizable monomer used to obtain a binder resin and a solution containing a colorant, a releasing agent and as required, a charge controlling agent are suspended in an aqueous medium to polymerize; and a dissolution suspension method in which a solution containing a binder resin, a colorant, a releasing agent and as required, a charge controlling agent are suspended in an aqueous solvent and granulated.

Moreover, a publicly known method may be used such as a production method in which the toner particle obtained in the above method is used as a core, and a coagulated particles are adhered to the core and fused under heating to make a toner have a core-shell structure. As to the method of producing the toner, in terms of the shape controllability and the particle size distribution controllability, the suspension polymerization method, the emulsion polymerization coagulating method, and the dissolution suspension method for producing in an aqueous solvent are preferred, and the emulsion polymerization coagulating method is particularly preferred.

The toner mother particle includes a binder resin, a colorant, and a releasing agent, and if required, includes a silica and a charge controlling agent.

Examples of the binder resin used for the toner mother particle include: homopolymers or copolymers of styrenes such as styrene, and chlorostyrene, monoolefins such as ethylene, propylene, butylene, and isoprene, vinylesters such as vinyl acetate, vinyl propionate, vinyl benzoate, and vinyl butyrate, α-methylene aliphatic monocarboxylates such as methylacrylate, ethylacrylate, butylacrylate, dodecylacrylate, octylacrylate, phenylacrylate, methylmethacrylate, ethylmethacrylate, butylmethacrylate, and dodecylmethacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone; and a polyester resin formed by copolymerization of a dicarboxylic acid and a diol.

Particularly typical examples of the binder resin include polystyrene, a styrene-alkylacrylate copolymer, a styrene-alkylmethacrylate copolymer, a styrene-acrylonitrile copolymer, a styrene-butadiene copolymer, a styrene-maleic acid anhydride copolymer, polyethylene, polypropylene, and a polyester resin. Furthermore, it may also include a polyurethane, an epoxy resin, a silicone resin, polyamide, modified rosin, and paraffin wax.

Typical examples of the colorant include magnetic powders such as magnetite and ferrite, carbon black, Aniline Blue, Chalcoil Blue, Chrome Yellow, Ultramarine Blue, Du Pont Oil Red, Quinoline Yellow, Methylene Blue Chloride, Phthalocyanine blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

Typical examples of the releasing agent include low-molecular polyethylene, low-molecular polypropylene, Fisher-Tropsch wax, montan wax, carnauba wax, rice wax, and candelilla wax.

As the charge controlling agent, publicly known charge controlling agents may be used, and there can be used azo type metal complex compounds, metal complex compounds of a salicylic acid, and resin type charge controlling agents containing a polar group. When the toner is produced by a wet type production method, a material which is hardly soluble in water may be used, in terms of controlling the ionic strength and reducing waste fluid pollution. Moreover, the toner may be either one of a magnetic toner in which a magnetic material is contained, and a non-magnetic toner containing no magnetic material.

The toner used for the developing device 25 can be produced by mixing the above toner mother particle and the external additives by a Henshel mixer, V-type blender, or the like. Moreover, when the toner mother particle is produced by a wet type method, it is also possible to externally add the additives by a wet method.

In the toner to be used for the developing device 25 lubricating particles may be added. As the lubricating particles, there may be used: solid lubricants such as graphite, molybdenum disulphide, talcum, fatty acids, and fatty acid metal salts; low-molecular weight polyolefins such as polyethylene, polypropylene, and polybutene; silicones which can be softened by heating; fatty acid amides such as oleamide, erucamide, ricinoleamide, and stearamide; vegetable waxes such as carnauba wax, rice wax, candelilla wax, Japan wax, and jojoba oil; animal waxes such as bees wax; mineral and petroleum waxes such as montan wax, ozocerite, ceresine, paraffin wax, microcrystalline wax, and Fischer-Tropsch wax; and modified products of these. These lubricating particles may be solely used, or two or more thereof may be used in a combination. The volume average diameter thereof is preferably in a range of 0.1 μm to 10 μm. The particle size may be equalized by crushing these products having the chemical structure mentioned above. The dosage thereof into the toner is desirably in a range of 0.05 weight % to 2.0 weight %, and more desirably a range of 0.1 weight % to 1.5 weight %.

In the toner used for the developing device 25, inorganic particles, organic particles, and complex particles having the organic particles adhered with the inorganic particles may be added, in order to remove the adhered substance and deteriorated substance on the surface of the electrophotographic photoreceptor.

Examples of the inorganic particles that may be used herein include various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

Moreover, the above inorganic particles may be treated with: a titanium coupling agent such as tetrabutyltitanate, tetraoctyltitanate, isopropyltriisostearoyltitanate, isopropyltridecylbenzenesulfonyltitanate, and bis(dioctylpyrophosphate)oxyacetate titanate; and a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. Moreover, inorganic particles hydrophobized by silicone oil or metal salts of higher fatty acids such as aluminum stearate, zinc stearate, and calcium stearate may be also used.

Examples of the organic particle include a styrene resin particle, a styrene acrylic resin particle, a polyester resin particle, and a urethane resin particle.

Regarding the particle diameter, the volume average particle diameter is desirably 5 nm to 1000 nm, more desirably 5 nm to 800 nm, and yet more desirably 5 nm to 700 mm. If the volume average particle diameter is less than the above lower limit, the abrasion ability is prone to be insufficient. On the other hand, if it exceeds the above upper limit, the surface of the electrophotographic photoreceptor is prone to be scratched. Moreover, the sum of the dosage of the particles and the lubricating particles mentioned above is preferably 0.6 weight % or more.

As the other inorganic oxides to be added into the toner, an inorganic oxide of a small diameter having a primary particle diameter of 40 nm or less may be used in order to control the powder flowability, the electrification and the like, and an inorganic oxide of a larger diameter may be added in order to reduce the adhesive power and to control the electrification. For these inorganic oxide particle, publicly known particles may be used. Silica and titanium oxide may be used together in order to accurately control the electrification. Moreover, by surface treatment of such an inorganic particle of a small diameter, the dispersibility may be increased, and the effect of improving the powder flowability may be increased. Furthermore, carbonates such as calcium carbonate and magnesium carbonate, and inorganic minerals such as hydrotalcite, may also added in order to remove the electric discharge product.

The electrophotographic color toner may be used by mixing with a carrier. Examples of the carrier used herein include iron powder, glass beads, ferrite powder, and nickel powder, and those having a resin coating on the surface thereof. Moreover, the blending proportion thereof to the carrier may be appropriately set.

The cleaning device 27 includes a fibrous member (roll shape) 27*a* and a cleaning blade (blade member) 27*b*.

The cleaning device 27 is provided with a fibrous member 27*a* and a cleaning blade 27*b*. However, the cleaning device may be provided with either one of these. The fibrous member 27*a* may be formed in a roll shape, or may be formed in a toothbrush shape. Moreover, the fibrous member 27*a* may be fixed to the cleaning device mainbody, may be rotatably supported thereon, or may be oscillatably supported thereon in the axial direction of the photoreceptor. Examples of the fibrous member 27*a* include: polyester, nylon, and acrylic fiber; a cloth formed from an ultra fine fiber such as TRACY (manufactured by Toray Industries, Inc.); and a brush shaped member having a resin fiber of nylon, acrylic compound, polyolefine, polyester, or the like, flocked in in a substrate form or a carpet form. Moreover, as the fibrous member 27*a*, there may be also used the above mentioned members mixed with a conductive powder and an ion conductive agent so as to apply the conductivity, or the fibrous member 27*a* include a conductive layer inside or outside of each fiber. If the conductivity is applied, the resistance value is desirably $10^2\Omega$ to $10^9\Omega$ per single fiber. The thickness of the fiber of the fibrous member 27*a* is desirably 30 d (denier) or less, and more desirably 20 d or less. The density of the fiber is desirably 20,000/inch$^2$ or more, and more desirably 30,000/inch$^2$ or more.

The cleaning device 27 is required to remove adhered substances (such as an electric discharge product) on the surface of the photoreceptor by a cleaning blade or a cleaning brush. In order to achieve this purpose for a long time, and to stabilize the function of the cleaning member, the cleaning member may be supplied with a lubricating material (lubricating component) such as a metallic soap, higher alcohol, wax, and silicone oil.

For example, if a roll shaped member is used as the fibrous member 27*a*, it is preferable to bringing into contact with a lubricating material such as a metallic soap and wax, so as to supply the lubricating constituent to the surface of the electrophotographic photoreceptor. For the cleaning blade 27*b*, an ordinary rubber blade is used. If such a rubber blade is used as the cleaning blade 27*b* in this manner, supplying a lubricating component to the surface of the electrophotographic photoreceptor is particularly effective to suppress chip off or abrasion of the blade.

The process cartridge 20 described above is detachable with respect to the image forming apparatus mainbody, and the image forming apparatus includes the process cartridge 20 and the image forming apparatus mainbody in its structure.

The exposure device 30 may be any type as long as it can expose the charged electrophotographic photoreceptor 1 to form an electrostatic latent image. Moreover, as the light source of the exposure device 30, a surface emission laser of a multi-beam method may be used.

The transfer device 40 may be any type as long as it can transfer the toner image on the electrophotographic photoreceptor 1 to the transfer target medium (intermediate transfer body 50), and for example ordinarily used devices in a roll shape may be used.

For the intermediate transfer body 50, a semiconductive polyimide, polyamideimide, polycarbonate, polyallylate, polyester, rubber, or the like in a belt shape (intermediate transfer belt) may be used. Moreover, the shape of the intermediate transfer body 50 may be a belt shape or may be a drum shape. There is an image forming apparatus of a direct transfer type which does not have this intermediate transfer body, and the electrophotographic photoreceptor of an aspect of the present invention is suitable for such an image forming apparatus. The reason is that an image forming apparatus of a direct transfer type has a tendency in that paper powder, talc, and the like are generated from a print sheet, which are easily adhered onto the electrophotographic photoreceptor, and these adhered substances cause image defects. However, according to the electrophotographic photoreceptor of an aspect of the present invention, since the cleaning property is excellent, paper powder, talc, and the like are readily removed, and a stable image can be obtained even with an image forming apparatus of a direct transfer type.

The transfer target medium in an aspect of the present invention is not specifically limited as long as it is a medium to which the toner image formed on the electrophotographic photoreceptor 1 is transferred. For example, if an image is transferred directly from the electrophotographic photoreceptor 1 to a paper or the like, the paper or the like is the transfer target medium. If the intermediate transfer body 50 is used, the intermediate transfer body is the transfer target medium.

Figure 3:
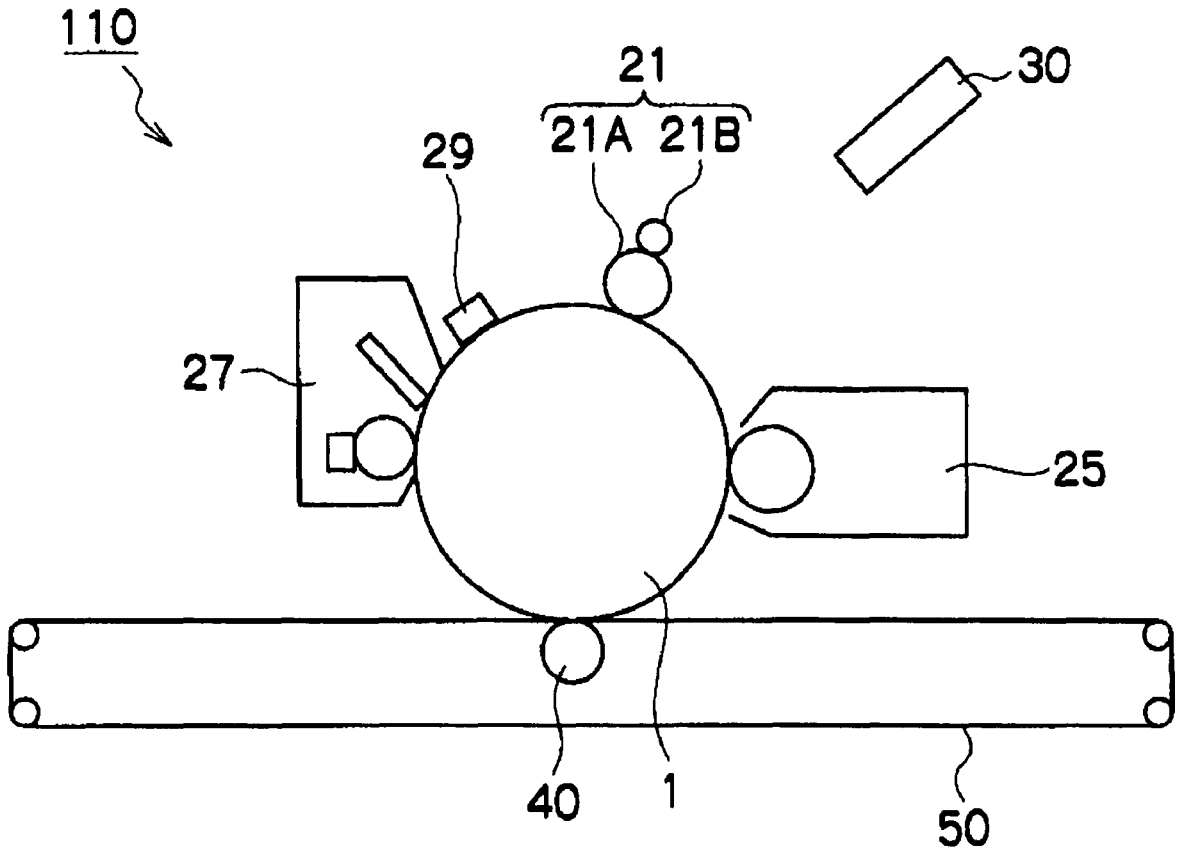
FIG. 3 is a schematic diagram showing another exemplary embodiment of the image forming apparatus of an aspect of the present invention.

FIG. 3 is a schematic diagram showing another exemplary embodiment of the image forming apparatus of an aspect of the present invention. In the image forming apparatus 110 shown in FIG. 3, the electrophotographic photoreceptor 1 is fixed to the image forming apparatus mainbody, and the charging device 21, the developing device 25, and the cleaning device 27 are respectively cartridged, and are independently installed as a charging cartridge, a developing cartridge, and a cleaning cartridge.

In the image forming apparatus 110, the electrophotographic photoreceptor 1 and the other devices are separated. The charging device 21, the developing device 25, and the cleaning device 27 are detachable by drawing or pushing, rather than being fixed to the image forming apparatus mainbody by means of a screw, caulking, bonding, or welding.

Since the electrophotographic photoreceptor of an aspect of the present invention has excellent abrasion resistance, cartridging may be unnecessary in some cases. Consequently, the charging device 21, the developing device 25, and the cleaning device 27 are designed to be respectively detachable by drawing or pushing, rather than being fixed to the mainbody by means of a screw, caulking, bonding, or welding, and thereby the cost for members per each print can be reduced. Moreover, two or more devices thereof may be integrated to form a detachable cartridge, and thereby the cost for members per each print can be further reduced.

The image forming apparatus 110 has the same structure as that of the image forming apparatus 100, except that the charging device 21, the developing device 25, and the cleaning device 27 are respectively cartridged. The other reference symbols in FIG. 3 denote the same parts as those in FIG. 2.

Figure 4:
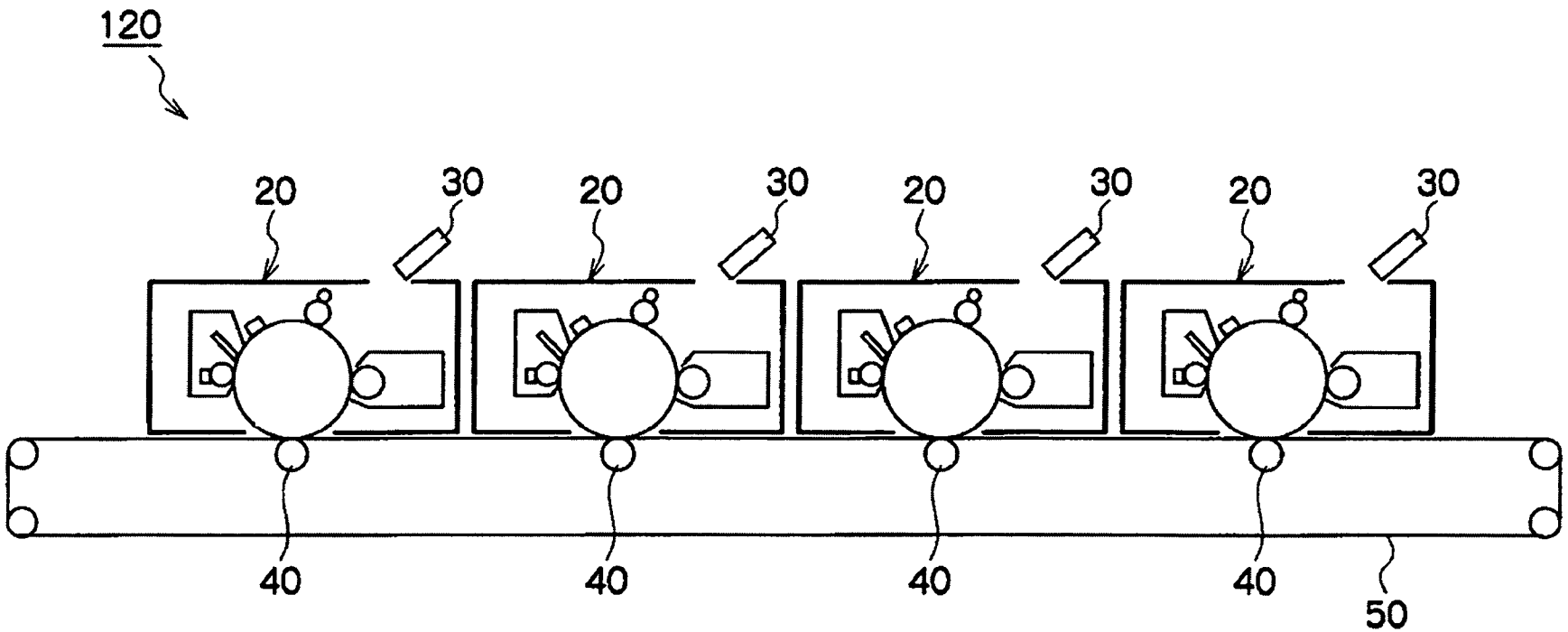
FIG. 4 is a schematic diagram showing yet another exemplary embodiment of the image forming apparatus of an aspect of the present invention.

FIG. 4 is a schematic diagram showing another exemplary embodiment of the image forming apparatus of an aspect of the present invention. The image forming apparatus, 120 is a tandem type full color image forming apparatus installed with four process cartridges 20. In the image forming apparatus 120, the structure is such that four process cartridges 20 are arranged in parallel on the intermediate transfer body 50, and one electrophotographic photoreceptor can be used for one color. The image forming apparatus 120 has the same structure as that of the image forming apparatus 100, except that the apparatus 120 is a tandem type. The other reference symbols in FIG. 4 denote the same parts as those in FIG. 2.

In the tandem type image forming apparatus 120, since the amount of abrasion of each electrophotographic photoreceptor differs due to the usage proportion of each color, the electrical characteristics of each electrophotographic photoreceptor is prone to be different. Accompanying this, the toner development characteristic gradually changes from the initial state to change the hue of the printed image, and therefore a stable image is prone to be unobtainable. In particular, in order to miniaturize the image forming apparatus, an electrophotographic photoreceptor having a small diameter tends to be used. If an electrophotographic photoreceptor of 30 mmϕ or less is used, this proneness becomes remarkable. Here, when the structure of the electrophotographic photoreceptor of an aspect of the present invention is employed, even if the diameter is less than 30 mmϕ, abrasion of the surface thereof may be suppressed. Therefore, the electrophotographic photoreceptor of an aspect of the present invention may be effective for a tandem type image forming apparatus.

Figure 5:
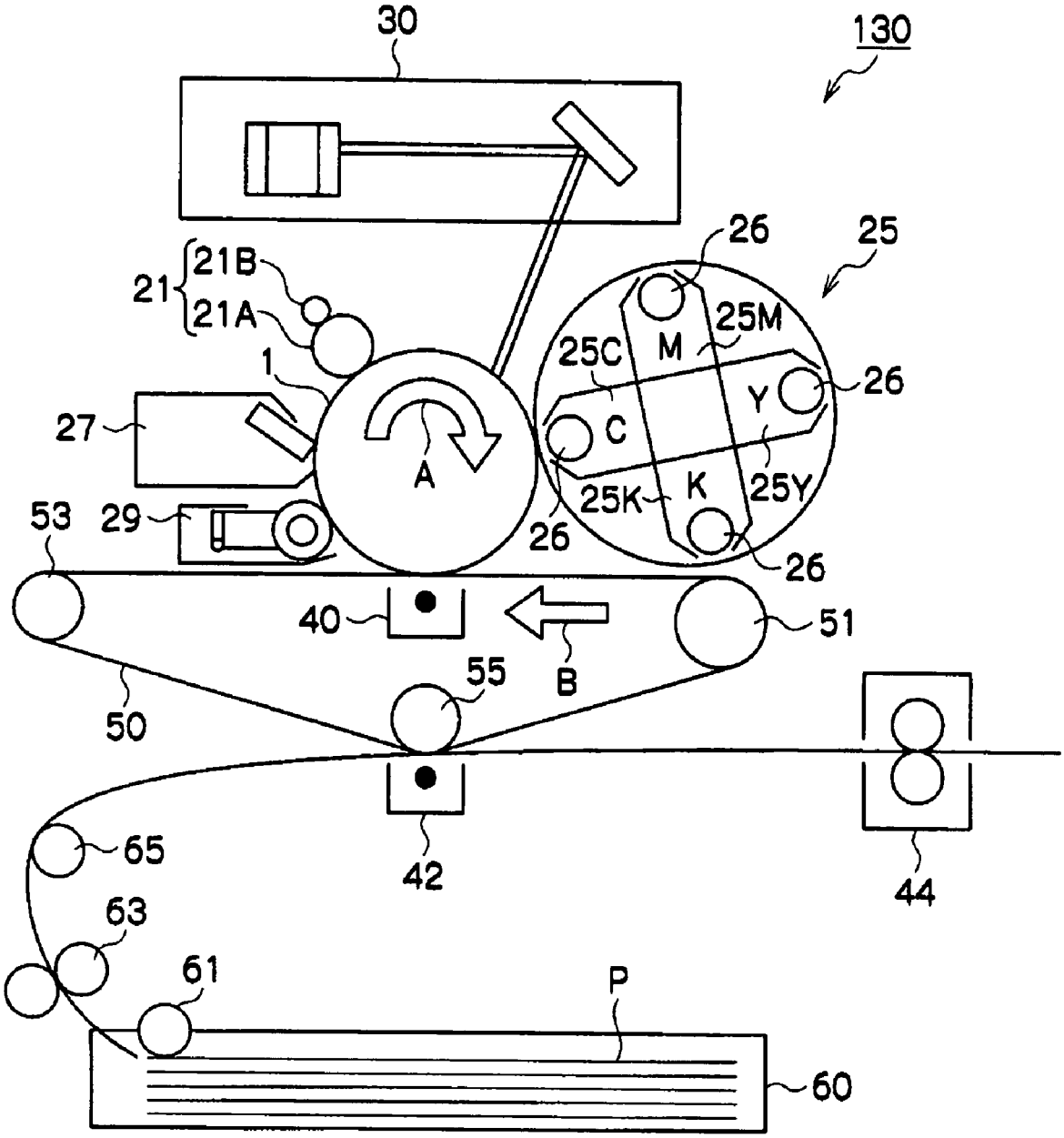
FIG. 5 is a schematic diagram showing yet another exemplary embodiment of the image forming apparatus of an aspect of the present invention.

FIG. 5 is a schematic diagram showing another exemplary embodiment of the image forming apparatus of an aspect of the present invention. The image forming apparatus 130 shown in FIG. 5 is a so-called four cycle type image forming apparatus in which toner images of multiple colors are formed with one electrophotographic photoreceptor. The image forming apparatus 130 includes a photoreceptor drum 1 which is rotated in the arrow A direction in the drawing at a predetermined rotational speed by a drive unit (not shown). On the upper side of the photoreceptor drum 1 is provided a charging device 21 which charges the peripheral surface of the photoreceptor drum 1. The charging device 21 includes a charging roller 21A and a cleaning roller 21B.

Moreover, above the charging device 21 is arranged an exposure device 30 which includes a plane emission laser array as an exposure light source. The exposure device 30 modulates multiple laser beams emitting from the light source according to the image to be formed, and deflects them in the main scanning direction, so as to scan over the peripheral surface of the photoreceptor drum 1 in parallel with the axis of the photoreceptor drum 1. As a result, an electrostatic latent image is formed on the peripheral surface of the charged photoreceptor drum 1.

To the side of the photoreceptor drum 1 is arranged the developing device 25. The developing device 25 includes a roll shaped housing which is rotatably arranged. Inside of this housing is formed with four storage units. In respective storage units are provided developing units 25Y, 25M, 25C, and 25K. The developing units 25Y, 25M, 25C, and 25K respectively include developer rolls 26, respectively storing toners of yellow (Y), magenta (M), cyan (C), and black (K) colors inside.

The image forming apparatus 130 forms a full color image while the photoreceptor drum 1 forms an image four times. That is, while the photoreceptor drum 1 forms four respective images of four colors, the charging device 21 charges the peripheral surface of the photoreceptor drum 1, and the exposure device 30 repeats to scan with laser beams that have been modulated according to any one of Y, M, C, and K image data showing the color image to be formed, over the peripheral surface of the photoreceptor drum 1, while switching the image data used for modulating the laser beams, per each image formation (image formation of one color) by the photoreceptor drum 1. Moreover, in a state where a developer roll 26 of any one of the developing units 25Y, 25M, 25C, and 25K is faced to the peripheral surface of the photoreceptor drum 1, the developing device 25 operates the developing unit faced to the peripheral surface, to develop the electrostatic latent image that has been formed on the peripheral surface of the photoreceptor drum 1 into a specific color, and to form a toner image of the specific color on the peripheral surface of the photoreceptor drum 1, which is repeated while rotating the housing so as to switch over the developing units used for developing the electrostatic latent image, per each color image formation (image formation of one color) by the photoreceptor drum 1. As a result, on the peripheral surface of the photoreceptor drum 1, Y, M, C, and K toner images are sequentially formed.

Moreover, on the lower side of the photoreceptor drum 1, an endless intermediate transfer belt 50 is arranged. The intermediate transfer belt 50 is wrapped over rollers 51, 53, and 55, and arranged so that the peripheral surface thereof is in contact with the peripheral surface of the photoreceptor drum 1. The rollers 51, 53, and 55 are rotated by transmission of a driving force of a motor (not shown), to rotate the intermediate transfer belt 50 in the arrow B direction in FIG. 5.

On the opposite side to the photoreceptor drum 1 over the intermediate transfer belt 50, a transfer device (transfer unit) 40 is arranged. The toner image that has been formed on the peripheral surface of the photoreceptor drum 1 is transferred to the image formation surface of the intermediate transfer belt 50 by the transfer device 40 one color by one color. Finally the images of all four colors are superimposed.

Moreover, on the opposite side to the developing device 25 over the photoreceptor drum 1, a lubricant supply device 29 and a cleaning device 27 are arranged on the peripheral surface of the photoreceptor drum 1. After the toner image that has been formed on the peripheral surface of the photoreceptor drum 1 is transferred onto the intermediate transfer belt 50, the lubricant supply device 29 supplies a lubricant to the peripheral surface of the photoreceptor drum 1, and an area in which the transferred toner image was held on the peripheral surface is cleaned by the cleaning device 27.

On the lower side of the intermediate transfer belt 50, a paper receiver 60 is arranged. In the paper receiver 60, multiple sheets of paper P serving as a recording material are piled and contained. On the left oblique upper side, a pick out roller 61 is arranged. On the downstream side in the direction of pick out of the paper P by means of the pick out roller 61, a roller pair 63 and a roller 65 are sequentially arranged. A recording paper positioned on the top of the piled paper is picked out from the paper receiver 60 by the rotation of the pick out roller 61, and conveyed by the roller pair 63 and the roller 65.

Furthermore, on the opposite side to the roller 55 over the intermediate transfer belt 50, a transfer device 42 is arranged. The paper P conveyed by the roller pair 63 and the roller 65 is sent to the portion between the intermediate transfer belt 50 and the transfer unit 42, and the toner image that has been formed on the image formation surface of the intermediate transfer belt 50 is transferred by the transfer device 42. On the downstream side in the conveyance direction of the paper P from the transfer device 42, a fixing device 44 including a fixing roller pair is arranged. After the transferred toner image is fused and fixed by the fixing device 44, the paper P having the toner image transferred thereon is ejected out from the image forming apparatus 130 and placed on the ejection paper receiver (not shown).

The structure of the process cartridge of an aspect the present invention, and the structure of the image forming apparatus of an aspect the present invention are not specifically limited, and each may be a publicly know structure.

EXAMPLES

Hereunder is a more detailed description of the present invention with reference to examples. However, the present invention is not limited to these examples.

(Production of Charging Roller)

As the core material, a core metal (Ni electroless depositioned SUM) having a length of 240 mm and an outer diameter ϕ of 8 mm is prepared. On this core material is sequentially formed an ion conductive layer which also functions as a thick conductive elastic layer, and a surface layer having a composition shown in the Table 2 below, via an adhesive layer (3 μm) of a phenolic conductive adhesive, so as to produce charging rollers A, B, and C.

TABLE 2

| | | | | Blending proportion | | |
|---|---|---|---|---|---|---|
| | | | Material Type | A | B | C |
| Ion conductive layer (also as elastic layer) | Composition | Rubber | epichlorohydrin | 96.4 phr | 75 phr | 96.4 phr |
| | | | NBR | 4.4 phr | 25 phr | 4.4 phr |
| | | Conductive material | quaternary ammonium salt "benzyltriethyl ammonium chloride" | 0.9 phr | — | — |
| | | | PEL | — | 0.9 phr | — |
| | | | lithium perchlorate | — | — | 3 phr |
| | | Conductive agent · Reinforcing agent | carbon black | 15 phr | 10 phr | 15 phr |
| | | Vulcanizing agent | sulfur | 0.5 phr | 0.5 phr | 0.5 phr |
| | | | sulfur dioxide | 1.6 phr | — | 1.6 phr |
| | | | peroxide | — | 5 phr | — |
| | | Vulcanization accelerator | TT (tetramethylthiuram disulfide) | 1.5 phr | 1.5 phr | 1.5 phr |
| | | | DM (dibenzothiazyl disulfide) | 1.5 phr | 1.5 phr | 1.5 phr |
| | | Filler | calcium carbonate | 20 phr | — | 20 phr |
| | | | Si powder | — | 20 phr | — |

TABLE 2-continued

| | | | Material Type | Blending proportion A | B | C |
|---|---|---|---|---|---|---|
| | | Vulcanization accelerator · activator | stearic acid<br>zinc flower (zinc oxide) | 1 phr<br>5 phr | 1 phr<br>5 phr | 1 phr<br>5 phr |
| | | Film thickness | | 3 mm | 3 mm | 3 mm |
| Surface layer | Composition | Resin | melamine "SUPERBECKAMINE G821-60" manufactured by Dainippon Ink and Chemicals Incorporated. | 342 g | 342 g | 342 g |
| | | | polyester "BILON 30SS" manufactured by Toyobo Co., Ltd. | 1300 g | 1300 g | 1300 g |
| | | Conductive material | carbon black "FW200" manufactured by Degussa | 10 wt % | 10 wt % | 10 wt % |
| | | Releasing agent | Fluororesin "RUBURON L-2" manufactured by Daikin Industries Ltd. | 200 g | 200 g | 200 g |
| | | Film thickness | | 15 μm | 15 μm | 20 μm |

(Production of Photoreceptor)

Firstly, a cylindrical aluminum base material having an outer diameter ϕ of 84 mm to which a honing treatment has been applied, is prepared. Next, 100 weight parts of zirconium compound (product name: ORGATIX ZC540, manufactured by Matsumoto Chemical Industry Co., Ltd.), 10 weight parts of silane compound (product name: A1110, manufactured by Nippon Unicar Company Limited), 400 weight parts of isopropanol, and 200 weight parts of butanol are mixed to obtain an undercoating layer forming coating liquid. This coating liquid is coated on the aluminum base material by immersion, and heated and dried at 150° C. for 10 minutes, to form an undercoating layer of 0.1 μm.

Next, 1 weight part of hydroxygalliumphthalocyanine having strong diffraction peaks at the Bragg angles (2θ±0.2°) of 7.5°, 9.9°, 12.5°, 16.3°, 18.6°, 25.1°, and 28.3° in the CuKα characteristic X-ray diffraction spectrum, 1 weight part of polyvinyl butylal (trade name name: S-LEC BM-S, manufactured by Sekisui Chemical Co., Ltd.), and 100 weight parts of n-butyl acetate are mixed, and are then dispersed together with glass beads for one hour by a paint shaker, so as to obtain a charge generating layer forming coating liquid. This coating liquid is coated on the undercoating layer by immersion, and heated and dried at 100° C. for 10 minutes, to form a charge generating layer of 0.15 μm.

Next, 2 weight parts of a charge transporting material shown in the following formula (V-3), 3 weight parts of a high molecular compound (viscosity average molecular weight: 50,000) having structural units as shown in the following formula (V-4), and 20 weight parts of chlorobenzene are mixed to obtain a charge transporting layer forming coating liquid.

(V-3)

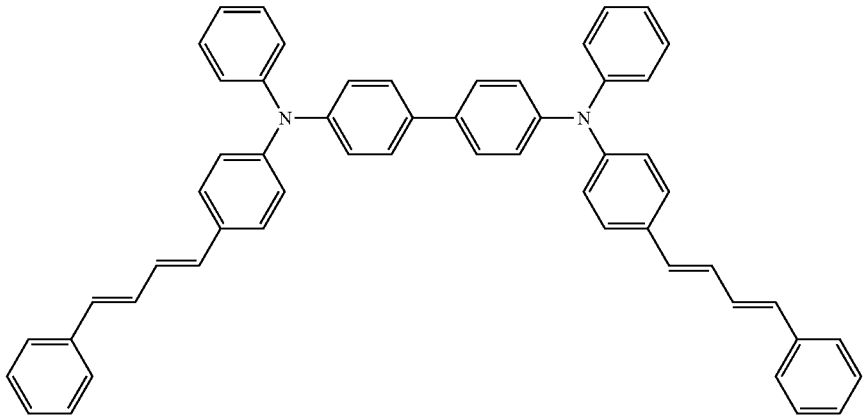

-continued (V-4)

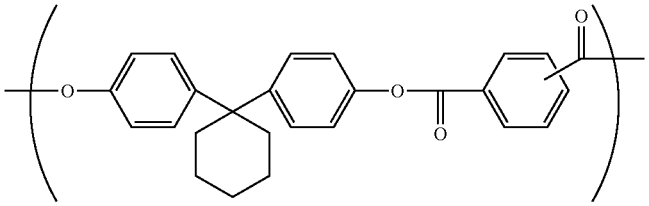

The obtained charge transporting layer forming coating liquid is coated on the charge generating layer by immersion coating method, and heated at 110° C. for 40 minutes, to form a charge transporting layer having a thickness of 20 μm. In this manner, the photoreceptor having the undercoating layer, the charge generating layer, and the charge transporting layer formed on the aluminum base material to which a honing treatment is applied, is referred to as "photoreceptor 1".

Next, 7 weight parts of a resol type phenolic resin (trade name: PL-2211, manufactured by Gun Ei Chemical Industry Co., Ltd.) and 0.03 weight parts of methylphenylpolysiloxane are prepared. This is then dissolved in 15 weight parts of isopropanol and 5 weight parts of methylethylketone, to obtain a protective layer forming coating liquid. This coating liquid is coated on the photoreceptor 1 by immersion coating method, and dried at 130° C. for 40 minutes, to form a protective layer having a thickness of 3 μm. The obtained photoreceptor is referred to as "photoreceptor 2".

Examples I-1 to I-8 and Comparative Examples I-1 to I-4

As shown in Table 3 and Table 4, predetermined materials and blending quantity are weighed out. They are sufficiently mixed using a high speed agitator (mixing temperature 25° C. and mixing time 10 seconds). Then, this blended liquid is transferred to a metal tray and foamed, and is then left at room temperature over night to obtain a urethane foam.

The obtained urethane foam is cut to a size of 20 mm×20 mm×250 mm, and a core material of SUS303 having an outer diameter ϕ of 5 mm and a length of 230 mm is inserted therein. The core material and the urethane foam are adhered using a hot melt adhesive. Then, the urethane foam is cut out respectively by 5 mm from the opposite ends of the core material so as to obtain an elastic roller. Grinding treatment is performed to obtain a charging member cleaning roller having an outer diameter ϕ of 9 mm. In Comparative Example I-4, urethane is not sufficiently foamed, and thus the cleaning roller may not be produced.

Together with the obtained cleaning roller, the charging roller and the photoreceptor as shown in Table 3 and Table 4 are installed in a modified DOCUPRINT 500 (manufactured by Fuji Xerox Co., Ltd.), so as to be pressed against the peripheral surface of the charging roller. A print test of continuous 100,000 sheets is performed to evaluate the cleaning property. The charging is performed by a direct current voltage method of 800 V. Moreover, the cleaning roller cleans so as to be driven to rotate together with the rotation of the charging roller.

The evaluation criterion of the cleaning property and the image quality is as follows and the judgement is performed by visual observation.

A: No change from the initial image quality

B: Infinitesimal disturbance in the image quality from the initial state, but at an unproblematic level at all.

C: A slight disturbance in the image quality from the initial state, but at an unproblematic level.

D: Generation of disturbance in the image quality from the initial state.

E: Generation of great disturbance in the image quality from the initial state.

Moreover, the following evaluation is also performed.

—Ozone Resistance Evaluation—

The ozone resistance is evaluated as follows. Ozone deterioration resistance; according to JIS K6301 ozone deterioration test (the disclosure of JIS K6301 is incorporated by reference herein), the sample is exposed to ozone for 200, 400, 600, and 800 hours, and the judgement is performed by visual observation and by touch. The evaluation criterion is as follows.

A: No change from the initial image state.

B: A slight deterioration compared to the initial state, but at an unproblematic level.

C: Generation of deterioration compared to the initial state.

D: Generation of great deterioration compared to the initial state.

—Abrasion Resistance Evaluation—

The abrasion resistance is evaluated as follows. At the time of the abovementioned cleaning property evaluation, the presence/absence of image defects due to the abrasion powder of the cleaning roller is judged by visual observation. The evaluation criterion is as follows.

A: No image defect at all.

B: A slight image defect, but at an unproblematic level.

C: Generation of image defects.

D: Generation of great image defects compared to the initial state.

—Repetitive Compression Fatigue Resistance Evaluation—

The repetitive compression fatigue resistance is evaluated as follows. At the time of completion of the abovementioned cleaning property evaluation, the presence/absence of image defects of the cleaning roller pitch is judged by visual observation. The evaluation criterion is as follows.

A: No image defect at all.

B: A slight image defect, but at an unproblematic level.

C: Generation of image defects.

D: Generation of great image defects compared to the initial state.

Comparative Example 1-5

The evaluation was performed in the same manner as that of Example I-1 except that BASOTECT manufactured by BASF is used as the charging member cleaning roller (shown as charging roller D in the Table).

TABLE 3

| | | | Example I-1 | Example I-2 | Example I-3 | Example I-4 | Example I-5 | Example I-6 | Example I-7 | Example I-8 |
|---|---|---|---|---|---|---|---|---|---|---|
| Photoreceptor | | | 1 | 1 | 1 | 1 | 2 | 1 | 1 | 2 |
| Charging roller | | | C | C | C | C | C | A | B | A |
| Type of cleaning roller | | | poly-urethane | poly-urethane | poly-urethane | poly-urethane | poly-urethane | poly-urethane | poly-urethane | poly-urethane |
| Com-po-si-tion | Type of polyol | Polyester 1 (adipate type polyester) | 100 | — | — | 100 | 100 | 100 | 100 | 100 |
| | | Polyester 2 (adipate type polyester) | — | 100 | — | — | — | — | — | — |
| | | Polyester 3 (aromatic type) | — | — | 100 | — | — | — | — | — |
| | | polyetherpolyol | — | — | — | — | — | — | — | — |
| | Foam stabi-lizer | sodium dioctyl sulfosuccinate | — | — | — | 1 | — | — | — | — |
| | | sodium sulfuric ester of castor oil | 1 | 1 | 1 | — | — | 1 | 1 | 1 |
| | | quaternary ammonium salt | — | — | — | — | 1 | — | — | — |
| | | silicone type foam stabilizer | — | — | — | — | — | — | — | — |
| | Foam-ing agent | water | 4 | 4 | 4 | 4 | 4 | 4 | 4 | 4 |
| | Catalyst | bis(2-dimethyl aminoethyl)ether | 0.2 | 0.2 | 0.2 | 0.2 | 0.2 | 0.2 | 0.2 | 0.2 |
| | | tin octylate | 0.2 | 0.2 | 0.2 | 0.2 | 0.2 | 0.2 | 0.2 | 0.2 |
| Isocyanate (TDI) | | | 47 | 47 | 12 | 47 | 47 | 47 | 47 | 47 |
| Cleaning property and image quality evaluation | | | C | C | C | C | B | B | B | A |
| Ozone resistance evaluation | | | B | B | B | B | B | B | B | B |
| Abrasion resistance evaluation | | | B | B | B | B | B | B | B | B |
| Repetitive compression fatigue resistance evaluation | | | B | B | B | B | B | B | B | B |

All composition numerals in the table represent weight parts.

TABLE 4

| | | | Comparative Example I-1 | Comparative Example I-2 | Comparative Example I-3 | Comparative Example I-4 | Comparative Example I-5 |
|---|---|---|---|---|---|---|---|
| Photoreceptor | | | 1 | 1 | 1 | 1 | 1 |
| Charging roller | | | C | C | C | C | D |
| Type of cleaning roller | | | polyurethane | polyurethane | polyurethane | polyurethane | melamine |
| Composition | Polyol | Polyester 1 (adipate type polyester) | 100 | — | 100 | 100 | — |
| | | Polyester 2 (adipate type polyester) | — | — | — | — | — |
| | | Polyester 3 (aromatic type) | — | — | — | — | — |
| | | Polyetherpolyol | — | 100 | — | — | — |
| | Foam stabilizer | sodium dioctyl sulfosuccinate | — | — | — | — | — |
| | | sodium sulfuric ester of castor oil | — | — | 1 | — | — |
| | | quaternary ammonium salt | — | — | — | — | — |
| | | silicone type foam stabilizer | 1 | 1 | — | — | — |
| | Foaming agent | water | 4 | 4 | 4 | 4 | — |
| | Catalyst | bis(2-dimethylaminoethyl)ether | 0.2 | 0.2 | — | 0.2 | — |
| | | tin octylate | 0.2 | 0.2 | — | 0.2 | — |
| Isocyanate (TDI) | | | 47 | 47 | 47 | 47 | — |
| Cleaning property and image quality evaluation | | | D | D | E | — | E |
| Ozone resistance evaluation | | | B | C | C | — | E |
| Abrasion resistance evaluation | | | B | C | C | — | E |
| Repetitive compression fatigue resistance evaluation | | | B | C | C | — | E |

All composition numerals in the table represent weight parts.

The details of the additives in Table 3 and Table 4 are as follows.

Polyester 1 (adipate type polyester): N2200 manufactured by Nippon polyurethane Industry Co., Ltd.

Polyester 2 (adipate type polyester): L50C manufactured by Mitsui Takeda Chemicals, Inc.

Polyester 3 (aromatic type): SPINODOL RD2321P manufactured by Dainippon Ink & Chemicals, Inc.

Polyetherpolyol: SANNIX FA226 manufactured by Sanyo Chemical Industries, Ltd. sodium dioctyl sulfosuccinate: SANMORIN OT-70 manufactured by Sanyo Kasei Co., Ltd.

Sodium sulfuric ester of castor oil: Turkey red oil A manufactured by Kyoeisha Chemical Co., Ltd.

Quaternary ammonium salt: CATIOLITE BC manufactured by Kyoeisha Chemical Co., Ltd.

Silicone type foam stabilizer: SZ-1142 manufactured by Nippon Unicar Company Limited Bis(2-dimethylaminoethyl) ether: TOYOCAT-ET manufactured by Tosoh Corporation.

Tin octylate: manufactured by Chukyo Yushi Co., Ltd.

Isocyanate (TDI): T-80 manufactured by Nippon polyurethane Industry Co., Ltd.

As mentioned above, in Examples I-1 to I-8 using the cleaning roller of embodiment A of an aspect of the present invention, it is found that the charging roller is satisfactorily cleaned by the cleaning roller for a long time. As a result, it is also found that satisfactory charging is performed for a long time and thus a satisfactory image is obtained.

Example II-1

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with a charging roller (roller diameter: 14 mm, roller length: 320 mm, shaft diameter: 8 mm, shaft length: 332 mm; roller including three layers of an adhesive layer, an elastic layer, and a resistive layer on a shaft, which is the same hereinafter), is installed in a modified DOCUCENTER Color a 450 manufactured by Fuji Xerox Co., Ltd. At the same time, a developer using a toner having a volume average diameter of 6.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

The objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (trade name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-2

In the following manner, a cleaning roller in which an elastic layer of a polyester urethane foam having a resilience of 17%, a hardness of 155N, and a number of cells of 45 cells/25 mm is provided on the core material, is formed.

The charging device that has been arranged so that the obtained cleaning roller is in contact with the charging roller (same as that of Example II-1), is installed in a modified DOCUCENTRE Color a 450 manufactured by Fuji Xerox Co., Ltd. At the same time, a developer using a toner having a volume average diameter of 6.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 25 weight parts of 4,4'-diphenylmethane diisocyanate (Product Name: MILIONATE MTL manufactured by Nippon Polyurethane Industries Ltd.), 0.7 weight parts of KAOLIZER No. 31 (tertiary amine catalyst manufactured by Kao Corporation), 1.5 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-3

In the following manner, a cleaning roller in which an elastic layer of a polyester urethane foam having a resilience of 28%, a hardness of 225N, and a number of cells of 55 cells/25 mm is provided on the core material, is formed.

The charging device that has been arranged so that the obtained cleaning roller is in contact with the charging roller, is installed in a modified DOCUCENTER Color a 450 manufactured by Fuji Xerox Co., Ltd. At the same time, a developer using a toner having a volume average diameter of 6.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 35 weight parts of 4,4'-diphenylmethane diisocyanate (Product Name: MILIONATE MTL manufactured by Nippon Polyurethane Industries Ltd.), 1.3 weight parts of KAOLIZER No. 31 (tertiary amine catalyst manufactured by Kao Corporation), 2.5 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-4

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 5.2 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-5

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 8.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-6

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 6.0 μm and an average shape factor SF1 of 115 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-7

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 6.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-8

In the following manner, a cleaning roller in which an elastic layer of a polyester urethane foam having a resilience of 22%, a hardness of 195N, and a number of cells of 35 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 6.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 1 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-9

In the following manner, a cleaning roller in which an elastic layer of a polyester urethane foam having a resilience of 22%, a hardness of 195N, and a number of cells of 65 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 6.0 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 3.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-10

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 3.5 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting material is taken out from the mold and the roller surface is ground to form the objective cleaning roller.

Example II-11

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 12 μm and an average shape factor SF1 of 130 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting material is taken out from the mold and the roller surface is ground to form the objective cleaning roller.

Example II-12

In the following manner, a cleaning roller in which an elastic layer of a polyester urethane foam having a resilience of 22%, a hardness of 195N, and a number of cells of 50 cells/25 mm is provided on the core material, is formed.

The charging device that has been arranged so that the obtained cleaning roller is in contact with the charging roller, is installed in a modified DOCUCENTRE Color a 450 manufactured by Fuji Xerox Co., Ltd. At the same time, a developer using a toner having a volume average diameter of 6.0 μm and an average shape factor SF1 of 140 is installed in the developing device, and a print test of 5,000 sheets is performed. The observation result of the charging roller surface state and the observation result of the printed image in the 5,000 sheet print test are shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 30 weight parts of 4,4'-diphenylmethane diisocyanate (Product Name: MILIONATE MTL manufactured by Nippon Polyurethane Industries Ltd.), 1 weight part of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-C-1

The test is performed in the same manner as that of example II-1, except that a cleaning roller having a resilience of 10% formed in the following manner, is used. The result is shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 15 weight parts of 4,4'-diphenylmethane diisocyanate (Product Name: MILIONATE MTL manufactured by Nippon Polyurethane Industries Ltd.), 0.5 weight parts of KAOLIZER No. 31 (tertiary amine catalyst manufactured by Kao Corporation), 2.0 weight parts of water (foaming agent), and 2 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-C-2

The test is performed in the same manner as that of Example II-1, except that a cleaning roller having a resilience of 45% formed in the following manner, is used. The result is shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 45 weight parts of 4,4'-diphenylmethane diisocyanate (Product Name: MILIONATE MTL manufactured by Nippon Polyurethane Industries Ltd.), 1.5 weight parts of KAOLIZER No. 31 (tertiary amine catalyst manufactured by Kao Corporation), 2.0 weight parts of water (foaming agent), and 2.0 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-C-3

The test is performed in the same manner as that of Example II-1, except that a cleaning roller having a hardness of 125N formed in the following manner, is used. The result is shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 17 weight parts of 4,4'-diphenylmethane diisocyanate (Product Name: MILIONATE MTL manufactured by Nippon Polyurethane Industries Ltd.), 0.4 weight parts of KAOLIZER No. 31 (tertiary amine catalyst manufactured by Kao Corporation), 2.0 weight parts of water (foaming agent), and 2.0 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

Example II-C-4

The test is performed in the same manner as that of Example II-1, except that a cleaning roller having a hardness of 240N formed in the following manner, is used. The result is shown in Table 5.

—Production of Cleaning Roller—

An objective urethane foam material is prepared by mixing 100 weight parts of polyester polyol (Product Name: SANESTER 22 manufactured by Sanyo Kasei Co., Ltd.), 45 weight parts of 4,4'-diphenylmethane diisocyanate (Product Name: MILIONATE MTL manufactured by Nippon Polyurethane Industries Ltd.), 2 weight parts of KAOLIZER No. 31 (tertiary amine catalyst manufactured by Kao Corporation), 2.0 weight parts of water (foaming agent), and 2.0 weight parts of potassium polyoxyethylene-alkylether phosphate (foam stabilizer manufactured by Kao Corporation). Next, an appropriate amount of the urethane foam material having such a formulation is injected into a mold having a shaft (diameter of 6 mm and length of 330 mm) previously arranged therein, and then left at 60° C. for 5 minutes to effect foaming and curing. Then, the resulting product is taken out from the mold and the roller surface is ground to form the objective cleaning roller.

TABLE 5

| | Cleaning roller | | | | Toner | | Observation | |
|---|---|---|---|---|---|---|---|---|
| | | | | | Volume | | | |
| | Resilience (%) | Hardness (N) | Type of urethane | Number of cells (No./25 mm) | average diameter (μm) | Average shape factor | result of charging roller surface state in 5000 sheet print test | Observation result of printed image in 5000 sheet print test |
| Example II-1 | 22 | 195 | polyester polyurethane | 50 | 6.0 | 130 | No adhered substance by visual observation up to 5000 sheets. Satisfactory. | No image defect up to 5000 sheets. Satisfactory. |
| Example II-2 | 17 | 155 | polyester polyurethane | 45 | 6.0 | 130 | No adhered substance by visual observation up to 5000 sheets. Satisfactory. | No image defect up to 5000 sheets. Satisfactory. |
| Example II-3 | 28 | 225 | polyester polyurethane | 55 | 6.0 | 130 | No adhered substance by visual observation up to 5000 sheets. Satisfactory. | No image defect up to 5000 sheets. Satisfactory. |
| Example II-4 | 22 | 195 | polyester polyurethane | 50 | 5.2 | 130 | No adhered substance by visual observation up to 5000 sheets. Satisfactory. | No image defect up to 5000 sheets. Satisfactory. |
| Example II-5 | 22 | 195 | polyester polyurethane | 50 | 8.0 | 130 | No adhered substance by visual observation up to 5000 sheets. Satisfactory. | No image defect up to 5000 sheets. Satisfactory. |
| Example II-6 | 22 | 195 | polyester polyurethane | 50 | 6.0 | 115 | No adhered substance by visual observation up to 5000 sheets. Satisfactory. | No image defect up to 5000 sheets. Satisfactory. |
| Example II-7 | 22 | 195 | polyester polyurethane | 50 | 6.0 | 130 | Adhered toner on charging roller surface after 3500 sheets. | Uneven density in image after 3500 sheets. |
| Example II-8 | 22 | 195 | polyester polyurethane | 35 | 6.0 | 130 | Adhered toner on charging roller surface after 3800 sheets. | Uneven density in image after 3800 sheets. |
| Example II-9 | 22 | 195 | polyester polyurethane | 65 | 6.0 | 130 | Broken powder of foam urethane on charging roller surface after 3300 sheets. | Fine dot-like defects in image after 3300 sheets. |
| Example II-10 | 22 | 195 | polyester polyurethane | 50 | 3.5 | 130 | Adhered toner on charging roller surface after 3900 sheets. | Uneven concentration in image after 3900 sheets. |
| Example II-11 | 22 | 195 | polyester polyurethane | 50 | 12 | 130 | Adhered toner on charging roller surface after 4000 sheets. | Uneven density in image after 4000 sheets. Reproducibility of dots and gradation are defective from initial stage. No image for actual usage is obtained. |
| Example II-12 | 22 | 195 | polyester polyurethane | 50 | 6.0 | 140 | Adhered toner on charging roller surface after 3700 sheets. | Uneven density in image after 3700 sheets. |
| Example II-C-1 | 10 | 195 | polyester polyurethane | 50 | 6.0 | 130 | Adhered toner on charging roller surface after 300 sheets. | Uneven density in image after 300 sheets. |
| Example II-C-2 | 45 | 195 | polyester polyurethane | 50 | 6.0 | 130 | Ununiform cut marks on charging roller surface after 500 sheets. | Stripe shaped defects in image after 500 sheets. |
| Example II-C-3 | 22 | 125 | polyester polyurethane | 50 | 6.0 | 130 | Adhered toner on charging roller surface after 400 sheets. | Uneven concentration in image after 400 sheets. |
| Example II-C-4 | 22 | 240 | polyester polyurethane | 50 | 6.0 | 130 | Fine scratches on charging roller surface after 650 sheets. | Fine stripe shaped defects in image after 650 sheets. |

As mentioned above, in Examples II-1 to II-12 using the cleaning roller of embodiment B of an aspect of the present invention, it is found that substances adhered on the charging member can be efficiently removed, a satisfactory cleaning performance can be kept for a long time, and it becomes possible to prevent image defect generation caused by contamination due to transfer residue of toner and foreign matter adhered/accumulated on the charging member surface.

Moreover, it is found that the cleaning property is improved by bringing the number of cells of the elastic layer, and the volume average diameter and average shape factor of the toner, in the cleaning roller to within predetermined ranges.

The foregoing description of the embodiments of an aspect of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member cleaning roller comprising:

a core body; and an elastic layer that is provided on a peripheral surface of the core body and comprises a urethane foam having an open-cell structure, a resilience of 15% to 30%, and a hardness of 150N to 230N, wherein the resilience is a ratio of a maximum height of rebound of a steel ball dropped from a height of 500 mm onto a top face of a first test piece, to a drop height of 500 mm, wherein the steel ball has a diameter of 16 mm and a weight of 16 g, and the first test piece has been cut out of the urethane foam and has a size of 50×100×100 mm or more; and wherein the hardness is a load applied to a second test piece, and is obtained by applying a first load by vertically pushing the second test piece such that a thickness of the second test piece becomes 75% of an initial thickness of the second test piece, immediately removing the first load, then applying, and maintaining for 20 seconds, a second load by vertically pushing the second test piece such that the thickness of the second test piece becomes 25% of the initial thickness of the second test piece, and then measuring the value of the second load, wherein the second test piece has a size of 50×380×380 mm.

2. The charging member cleaning roller according to claim 1, wherein the number of cells in the open-cell structure is in a range of 40 cells/25 mm to 58 cells/25 mm.

3. The charging member cleaning roller according to claim 1, wherein the urethane foam is a polyester urethane foam.

4. A charging device comprising:

a substantially roll-shaped charging member that charges an image holding member; and a charging member cleaning roller arranged in contact with a peripheral surface of the charging member, the charging member cleaning roller comprising: a core body; and an elastic layer that is provided on a peripheral surface of the core body and comprises a urethane foam having an open-cell structure, a resilience in a range of 15% to 30%, and a hardness in a range of 150N to 230N, wherein the resilience is a ratio of a maximum height of rebound of a steel ball dropped from a height of 500 mm onto a top face of a first test piece, to a drop height of 500 mm, wherein the steel ball has a diameter of 16 mm and a weight of 16 g, and the first test piece has been cut out of the urethane foam and has a size of 50×100×100 mm or more; and wherein the hardness is a load applied to a second test piece, and is obtained by applying a first load by vertically pushing the second test piece such that a thickness of the second test piece becomes 75% of an initial thickness of the second test piece, immediately removing the first load, then applying, and maintaining for 20 seconds, a second load by vertically pushing the second test piece such that the thickness of the second test piece becomes 25% of the initial thickness of the second test piece, and then measuring the value of the second load, wherein the second test piece has a size of 50×380×380 mm.

5. The charging device according to claim 4, wherein the number of cells in the open-cell structure is in a range of 40 cells/25 mm to 58 cells/25 mM.

6. The charging device according to claim 4, wherein the urethane foam is a polyester urethane foam.

7. A process cartridge comprising:

a charging device that charges an image holding member; and at least one device selected from the group consisting of a developing device that develops an electrostatic latent image formed on the image holding member using a toner to form a toner image, and a cleaning device that removes residual toner on the surface of the image holding member, the charging device comprising:

a substantially roll-shaped charging member that charges the image holding member; and a charging member cleaning roller arranged in contact with a peripheral surface of the charging member, the cleaning roller comprising: a core body; and an elastic layer that is provided on a peripheral surface of the core body and comprises a urethane foam having an open-cell structure, a resilience in a range of 15% to 30%, and a hardness in a range of 150N to 230N, wherein the resilience is a ratio of a maximum height of rebound of a steel ball dropped from a height of 500 mm onto a top face of a first test piece, to a drop height of 500 mm, wherein the steel ball has a diameter of 16 mm and a weight of 16 g, and the first test piece has been cut out of the urethane foam and has a size of 50×100×100 mm or more; and wherein the hardness is a load applied to a second test piece, and is obtained by applying a first load by vertically pushing the second test piece such that a thickness of the second test piece becomes 75% of an initial thickness of the second test piece, immediately removing the first load, then applying, and maintaining for 20 seconds, a second load by vertically pushing the second test piece such that the thickness of the second test piece becomes 25% of the initial thickness of the second test piece, and then measuring the value of the second load, wherein the second test piece has a size of 50×380×380 mm.

8. An image forming apparatus comprising:

an image holding member;

a charging device that charges the image holding member;

an exposure device that forms an electrostatic latent image on the charged image holding member;

a developing device that develops the electrostatic latent image formed on the image holding member using a toner to form a toner image; and a transfer device that transfers the toner image onto a transfer body, the charging device comprising:

a substantially roll-shaped charging member that charges the image holding member; and a charging member cleaning roller arranged in contact with a peripheral surface of the charging member, the cleaning roller comprising: a core body; and an elastic layer that is provided on a peripheral surface of the core body and comprises a urethane foam having an open-cell structure, a resilience in a range of 15% to 30%, and a hardness in a range of 150N to 230N, wherein the resilience is a ratio of a maximum height of rebound of a steel ball dropped from a height of 500 mm onto a top face of a first test piece, to a drop height of 500 mm, wherein the steel ball has a diameter of 16 mm and a weight of 16 g, and the first test piece has been cut out of the urethane foam and has a size of 50×100×100 mm or more; and wherein the hardness is a load applied to a second test piece, and is obtained by applying a first load by vertically pushing the second test piece such that a thickness of the second test piece becomes 75% of an initial thickness of the second test piece, immediately removing the first load, then applying, and maintaining for 20 seconds, a second load by vertically pushing the second test piece such that the thickness of the second test piece becomes 25% of the initial thickness of the second test piece, and then measuring the value of the second load, wherein the second test piece has a size of 50×380×380 mm.

9. The charging member cleaning roller according to claim 1, wherein the hardness of the urethane foam ranges from 190N to 210N.

10. The charging device according to claim 4, wherein the hardness of the urethane foam ranges from 190N to 210N.

11. The process cartridge according to claim 7, wherein the hardness of the urethane foam ranges from 190N to 210N.

12. The image forming apparatus according to claim 8, wherein the hardness of the urethane foam ranges from 190N to 210N.

* * * * *